US011195685B2

(12) United States Patent
Iijima

(10) Patent No.: US 11,195,685 B2
(45) Date of Patent: Dec. 7, 2021

(54) ELECTRON GUN, ELECTRON BEAM APPLICATOR, METHOD FOR RELEASING ELECTRONS USING ELECTRON GUN, AND METHOD FOR ADJUSTING FOCAL POSITION OF ELECTRON BEAM

(71) Applicant: Photo electron Soul Inc., Nagoya (JP)

(72) Inventor: Hokuto Iijima, Nagoya (JP)

(73) Assignee: Photo electron Soul Inc., Nagoya (JP)

( * ) Notice: Subject to any disclaimer, the term of this patent is extended or adjusted under 35 U.S.C. 154(b) by 0 days.

(21) Appl. No.: 17/044,856

(22) PCT Filed: Aug. 7, 2019

(86) PCT No.: PCT/JP2019/031052
§ 371 (c)(1),
(2) Date: Oct. 1, 2020

(87) PCT Pub. No.: WO2020/079929
PCT Pub. Date: Apr. 23, 2020

(65) Prior Publication Data

US 2021/0134551 A1 May 6, 2021

(30) Foreign Application Priority Data

Oct. 16, 2018 (JP) ..... JP2018-194848

(51) Int. Cl.
*H01J 3/14* (2006.01)
*H01J 31/04* (2006.01)
(Continued)

(52) U.S. Cl.
CPC ..... *H01J 3/14* (2013.01); *H01J 1/34* (2013.01); *H01J 1/46* (2013.01); *H01J 3/021* (2013.01); *H01J 31/04* (2013.01)

(58) Field of Classification Search
CPC .... H01J 3/14; H01J 31/04; H01J 3/021; H01J 1/46; H01J 1/34
See application file for complete search history.

(56) References Cited

U.S. PATENT DOCUMENTS 3,995,194 A 11/1976 Blacker et al.
4,703,228 A 10/1987 West
5,426,686 A 6/1995 Rentzepis et al.
5,489,814 A 2/1996 Banbury
(Continued)

FOREIGN PATENT DOCUMENTS

JP S 62234849 A 10/1987
JP H 03238742 A 10/1991
(Continued)

OTHER PUBLICATIONS

Extended European Search Report dated May 6, 2021 for corresponding European application No. 19874594.5, pp. 1-10.
(Continued)

*Primary Examiner* — Joseph L Williams
(74) *Attorney, Agent, or Firm* — Intellectual Property Law Group LLP

(57) ABSTRACT

The present invention addresses the problem of providing a device with which it is possible to adjust the focal point of an electron beam both toward a shorter focal point and toward a longer focal point after an electronic gun was fitted on a counterpart device.
The aforementioned problem can be solved by
an electron gun including
a photocathode, and
an anode,
the electron gun furthermore comprising an intermediate electrode disposed between the photocathode and the anode,
the intermediate electrode comprising an electron-beam passage hole through which an electron beam released from the photocathode passes, and
(Continued)

the electron-beam passage hole having formed therein a drift space in which, when an electrical field is formed between the photocathode and the anode due to application of a voltage, the effect of the electrical field can be disregarded.

20 Claims, 14 Drawing Sheets

(51) Int. Cl.

| | |
|---|---|
| ***H01J 1/34*** | (2006.01) |
| ***H01J 1/46*** | (2006.01) |
| ***H01J 3/02*** | (2006.01) |

(56) References Cited

U.S. PATENT DOCUMENTS

| | | | |
|---|---|---|---|
| 6,215,128 | B1 | 4/2001 | Mankos et al. |
| 9,934,926 | B2 | 4/2018 | Nishitani |
| 2010/0187433 | A1 | 7/2010 | Eastham |

FOREIGN PATENT DOCUMENTS

| | | | |
|---|---|---|---|
| JP | 2000123716 | A | 4/2000 |
| JP | 2002-539633 | A | 11/2002 |
| JP | 2010517233 | A | 5/2010 |
| JP | WO 2011/034086 | A1 | 3/2011 |
| JP | 2013211231 | A | 10/2013 |
| JP | WO 2015/008561 | A1 | 1/2015 |
| JP | 2015022810 | A | 2/2015 |
| KR | 2003-0083464 | A | 10/2003 |

OTHER PUBLICATIONS

International Search Report, dated Oct. 29, 2019 for corresponding International Application No. PCT/JP2019/031052 with English translation.

Written Opinion of the ISA, dated Oct. 29, 2019 for corresponding International Application No. PCT/JP2019/031052 with English translation (4 pages).

Japan Office Action, dated Oct. 30, 2018 for corresponding Japanese Patent Application No. 2018-194848 with English translation (8 pages).

A

B

ELECTRON GUN, ELECTRON BEAM APPLICATOR, METHOD FOR RELEASING ELECTRONS USING ELECTRON GUN, AND METHOD FOR ADJUSTING FOCAL POSITION OF ELECTRON BEAM

CROSS-REFERENCE TO RELATED APPLICATIONS

This application is a U.S. National Phase application, under 35 U.S.C. § 371, of International Application no. PCT/JP2019/031052, with an international filing date of Aug. 7, 2019, and claims priority to Japanese application no. 2018-194848, filed on Oct. 16, 2018, each of which is hereby incorporated by reference for all purposes.

TECHNICAL FIELD

The disclosure in the present application relates to an electron gun, an electron beam applicator, a method for releasing electrons using an electron gun, and a method for adjusting the focal position of an electron beam.

TECHNICAL BACKGROUND

Electron beam applicators such as electron guns fitted with photocathodes, electron microscopes that include these electron guns, free electron laser accelerators, and inspection devices are known (below, electron beam applicators from which an electron gun is removed are also referred to as "counterpart devices") (see Patent Document 1).

In devices comprising electron guns, it is preferable to obtain bright images and high resolution. Therefore, when an electron gun is first fitted on a counterpart device or when the electron gun is replaced, work for adjusting the impingement axis of an electron beam is typically performed so that an electron beam released from the electron gun will align with the optical axis of an electronic optical system of the counterpart device. In addition to the adjustment of the impingement axis of the electron beam, work for adjusting a focal position is also typically performed so that the electron beam is focused at a desired position in the counterpart device.

Aside from adjusting the attachment position of an electron gun, providing a Wehnelt electrode between a photocathode and an anode is also known as a method for adjusting the focal position of an electron beam (see Patent Documents 2 and 3). Applying a voltage to the Wehnelt electrode makes it possible to reduce the beam size of an electron beam released from the photocathode; as a result, the focal position can be moved closer to the electron gun than in a case where a Wehnelt electrode is not used.

PRIOR ART LIST

Patent Document 1: International Publication No. 2015/008561

Patent Document 2: International Publication No. 2011/034086

Patent Document 3: Domestic Republication No. 2002-539633

SUMMARY OF THE INVENTION

Problems to be Solved by the Invention

As described above, using a Wehnelt electrode makes it possible to change the focal position of an electron gun in a state in which the electron gun has been secured after the electronic gun was fitted on the counterpart device. Depending on the position of the electron gun on the counterpart device, there is also a case where the focal point want be controlled in a direction away from the electron gun (also referred to as a direction "toward a longer focal point" below). However, the inventors found that the following problems arise when a Wehnelt electrode is used.

(1) The Wehnelt electrode is used in order to adjust the focal position toward the electron gun (also referred to as a direction "toward a shorter focal point" below) by reducing the beam size of the electron beam (squeezing the electron beam) when a voltage is applied. Therefore, the focal position normally can be adjusted only toward a shorter focal point.

(2) When the electron gun is fitted on the counterpart device, the default setting is assumed to be a state in which what is applied is a voltage of a value approximately midway between upper- and lower-limit values of a voltage to be applied to the Wehnelt electrode. In this case, adjusting the voltage value applied to the Wehnelt electrode makes it possible, in principle, to adjust the focal point of an electron beam toward a shorter focal point and toward a longer focal point after the electronic gun was fitted on the counterpart device. However, the Wehnelt electrode reduces the beam size of the electron beam through use of an electrical field generated by applying a voltage to an electrode. Therefore, the width of the electron beam can be adjusted only while the electron beam passes through the Wehnelt electrode, and thus even if the focal position can be adjusted toward a shorter focal point and toward a longer focal point, the range of adjustment is narrow.

(3) At present, no method (device) for adjusting the focal point of an electron beam both toward a shorter focal point and toward a longer focal point, i.e., in two different directions after the electronic gun was fitted on the counterpart device is known, other than through the use of a Wehnelt electrode.

As a result of thorough research, the inventors newly found that, by using a novel method (device) in which: (1) an intermediate electrode is provided between a photocathode and an anode; (2) the intermediate electrode is provided with an electron-beam passage hole having formed therein a drift space in which, when an electrical field is formed between the photocathode and the anode due to a voltage applied, the effect of the electrical field can be disregarded; and (3) when an electron beam released from the photocathode is released toward the anode through the electron-beam passage hole in which the drift space is formed, the width of the electron beam in the drift space is increased, it is possible to adjust the focal position of the electron beam both toward a shorter focal point and toward a longer focal point.

Accordingly, an object of the disclosure in the present application is to provide an electron gun, an electron beam applicator, a method for releasing electrons using an electron gun, and a method for adjusting the focal position of an electron beam in which there is used a new device (method) with which it is possible to adjust the focal position of an electron beam both toward a shorter focal point and toward a longer focal point. Other arbitrary additional effects of the disclosure in the present application are clarified in the description of the embodiments.

Means to Solve the Problems

The present application relates to the electron gun, the electron beam applicator, the method for releasing electrons using an electron gun, and the method for adjusting the focal position of an electron beam that are indicated below.

(1) An electron gun comprising:

a photocathode, and an anode, the electron gun furthermore comprising an intermediate electrode disposed between the photocathode and the anode, the intermediate electrode comprising an electron-beam passage hole through which an electron beam released from the photocathode passes, and the electron-beam passage hole having formed therein a drift space in which, when an electrical field is formed between the photocathode and the anode due to application of a voltage, the effect of the electrical field can be disregarded, the drift space being used for spreading the width of the electron beam passing therethrough.

(2) The electron gun according to (1) above, wherein the intermediate electrode is such that the ratio $D/(a/2+b/2)$ is greater than 1, where D is defined as the center-axis-direction length of the electron-beam passage hole, a is defined as a cross-sectional length of an electron-beam entrance of the electron-beam passage hole, and b is defined as a cross-sectional length of an electron-beam exit of the electron-beam passage hole.

(3) The electron gun according to (1) or (2) above, wherein the electron gun comprises a drive unit for driving the intermediate electrode in the center-axis direction of the electron-beam passage hole between the photocathode and the anode.

(4) The electron gun according to any of (1) to (3) above, wherein a center-axis-direction length D of the electron-beam passage hole in the intermediate electrode is variable.

(5) The electron gun according to any of (1) to (4) above, wherein the electron gun comprises a power source that forms an electrical field between the photocathode and the anode and applies a voltage to the intermediate electrode.

(6) The electron gun according to (5) above, wherein the power source can apply, to the intermediate electrode, a voltage within a range that is relatively more positive than a first voltage and relatively more negative than a second voltage, where the first voltage is defined as the voltage of the photocathode, and the second voltage is defined as the voltage of the anode.

(7) The electron gun according to any of (1) to (6) above, wherein the electron gun comprises a drive unit for driving the photocathode and/or the anode in the center-axis direction of the electron-beam passage hole.

(8) An electron beam applicator comprising the electron gun according to any of (1) to (7) above, wherein the electron beam applicator is a free electron laser accelerator, an electron microscope, an electron-beam holography device, an electron-beam drawing device, an electron-beam diffraction device, an electron-beam inspection device, an electron-beam metal additive manufacturing device, an electron-beam lithography device, an electron beam processing device, an electron-beam curing device, an electron-beam sterilization device, an electron-beam disinfection device, a plasma generation device, an atomic element generation device, a spin-polarization electron-beam generation device, a cathode luminescence device, or an inverse photoemission spectroscopy device.

(9) A method for releasing an electron beam using an electron gun, the method for releasing an electron beam comprising:

an electron beam release step in which an electron beam is released from a photocathode toward an anode;

a drift space passage step in which the electron beam released from the photocathode passes through a drift space which is formed in an electron-beam passage hole of an intermediate electrode, in which the effect of an electrical field formed between the photocathode and the anode due to application of a voltage can be disregarded, the drift space being used for spreading a width of the electron beam passing therethrough; and an electron beam convergence step in which the electron beam after the drift space passage step converges toward the anode.

(10) A method for adjusting the focal position of an electron beam, the method being such that an electron beam width adjustment step is included between the electron beam release step (ST1) and the electron beam convergence step (ST3) in the method for releasing an electron beam using an electron gun according to (9) above.

Advantageous Effects of the Invention

According to the disclosure in the present application, it is possible to adjust the focal position of an electron beam both toward a shorter focal point and toward a longer focal point even after the electronic gun was fitted on the counterpart device.

DESCRIPTION OF THE EMBODIMENTS

Below is a detailed description, made with reference to the drawings, of an electron gun, an electron beam applicator, a method for releasing electrons using an electron gun, and a method for adjusting the focal position of an electron beam. In the present specification, members having the same function are designated by the same or similar symbols. In some instances, members designated by the same or similar symbols are described no more than once.

(Embodiment of Electron Gun)

Figure 1:
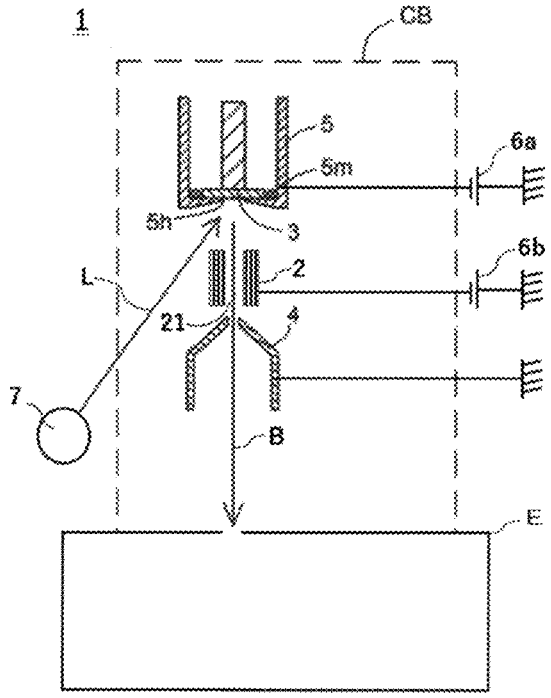
FIG. 1 is a schematic view illustrating an electron gun 1, and a device fitted with the electron gun 1.

An overview of a configuration example of an electron gun is described with reference to FIG. 1. FIG. 1 is a schematic view illustrating an electron gun 1, and a counterpart device E fitted with the electron gun 1.

This embodiment of the electron gun 1 comprises at least an intermediate electrode 2, a photocathode 3, and an anode 4. A power source 6 and a light source 7 may also be provided, as necessary, as elements constituting the electron gun 1. The power source 6 and the light source 7 may be separately attached when actuating the electron gun 1.

The intermediate electrode 2 has an electron-beam passage hole 21 through which an electron beam released from the photocathode 3 passes. A drift space, in which it is possible to disregard the effect of an electrical field formed by a difference in voltage between the photocathode 3 and the anode 4, is formed in the electron-beam passage hole 21. Detailed description of the configuration of the intermediate electrode 2 is given below.

In the example shown in FIG. 1, the intermediate electrode 2, the photocathode 3, and the anode 4 are disposed within a vacuum chamber CB. The photocathode 3 releases an electron beam B in response to receiving excitation light L radiated from the light source 7. More specifically, electrons in the photocathode are excited by the excitation light L, and the excited electrons are released from the photocathode 3. The released electrons are formed into the electron beam B by an electrical field formed by the anode 4 and the cathode 3. As pertains to the terms "photocathode" and "cathode" in the present specification, there are instances where "photocathode" is used when referring to release of the electron beam, and where "cathode" is used when referring to an electrode that is counter to the "anode"; however, the reference sign "3" is used for both "photocathode" and "cathode."

In the example shown in FIG. 1, the photocathode 3 is irradiated with the excitation light L via the front surface thereof. Alternatively, the photocathode 3 is irradiated with the excitation light L via the rear surface thereof. In addition, in the example shown in FIG. 1, the photocathode 3 is disposed within a photocathode-accommodating vessel 5 comprising an electron-beam passage hole 5*h*. A treatment material 5*m* for subjecting the photocathode 3 to an EA surface treatment (i.e., an electron-affinity-lowering treatment) may be disposed within the photocathode-accommodating vessel 5.

There is no particular limitation as to a photocathode material for forming the photocathode 3, provided that it is possible for the photocathode material to release an electron beam due to being irradiated with excitation light. Examples of the photocathode material include materials that require EA surface treatment, and materials that do not require EA surface treatment. Examples of materials that require EA surface treatment include III-V group semiconductor materials and II-VI group semiconductor materials. Specific examples include AlN, $Ce_2Te$, GaN, compounds of Sb with one or more alkali metals, AlAs, GaP, GaAs, GaSb, and InAs, as well as mixed crystals of these. Other examples of such materials include metals; specific examples include Mg, Cu, Nb, $LaB_6$, $SeB_6$, and Ag. The photocathode 3 can be fabricated by subjecting the photocathode material to EA surface treatment, and, with this photocathode 3, not only will it be possible to select excitation light from within a near-ultraviolet to infrared wavelength region corresponding to the gap energy of the semiconductor, but it will also be possible for the electron-beam source capabilities (quantum yield, durability, monochromaticity, temporal response, and spin polarization) corresponding to the electron beam application to be exhibited by selecting the material and structure of the semiconductor.

Examples of materials that do not require EA surface treatment include: Cu, Mg, Sm, Tb, Y, and other single metals, or alloys or metal compounds thereof; and diamond, WBaO, and $Cs_2Te$. A photocathode that does not require EA surface treatment is preferably fabricated through a publicly known method (for example, see Japanese Patent No. 3537779). In cases where a photocathode that does not require EA surface treatment is used as the photocathode 3, it is permissible for the photocathode-accommodating vessel 5 not to be disposed.

There is no particular limitation as to the anode 4, provided that it is possible to form an electrical field together with the cathode 3. An anode that is typically used in the field of electron guns can be used as the anode 4.

In this embodiment of the electron gun 1, there is no particular limitation as to the disposition of the power source, provided that it is possible for the electron beam B to be released from the cathode 3 toward the anode 4. For example, (1) an electrical field is preferably formed between the cathode 3 and the anode 4 by providing a difference in potential such that a second voltage is relatively more positive than a first voltage, and (2) a voltage is preferably applied to the intermediate electrode 2 within a range that is relatively more positive than the first voltage and relatively more negative than the second voltage, where the first voltage is defined as the voltage of the cathode 3, and the second voltage is defined as the voltage of the anode 4.

The voltage applied to the intermediate electrode 2 may be variable, provided that the voltage is within the range that is relatively more positive than the first voltage and relatively more negative than the second voltage.

More specifically, in the example shown in FIG. 1, two power sources, i.e., a first power source 6*a* and a second power source 6*b* are provided. In the example shown in FIG. 1, a voltage is applied to the cathode 3 ("photocathode 3," or "photocathode 3 and photocathode-accommodating vessel 5") by the first power source 6*a*, whereby a difference in potential is generated between the cathode 3 and the anode 4 and an electrical field can be formed. A voltage can be applied to the intermediate electrode 2 using the second power source 6*b*.

Figure 2:
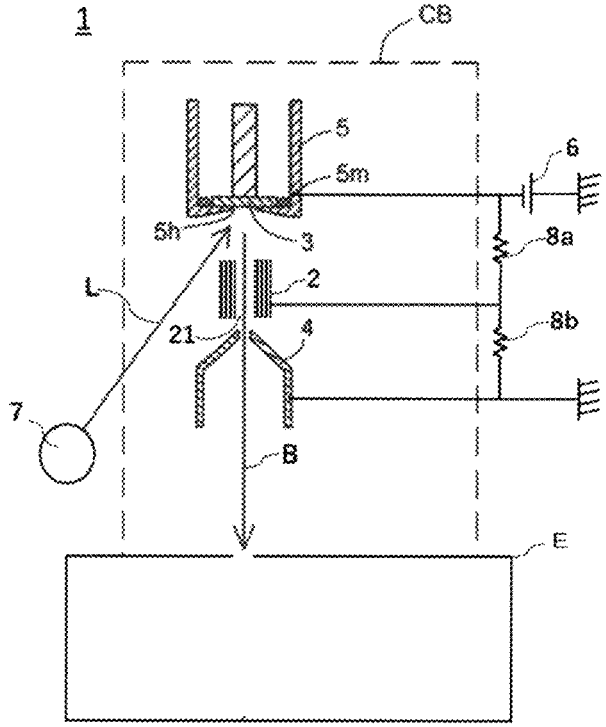
FIG. 2 is a schematic view illustrating an electron gun 1, and a device fitted with the electron gun 1.

FIG. 2 shows an example in which one power source 6 is provided. In the example shown in FIG. 2, a first resistor 8*a* is provided to a circuit connecting the power source 6 and the intermediate electrode 2, and a second resistor 8*b* is provided to a circuit connecting the power source 6 and the anode 4, the second resistor 8*b* being provided further toward the anode 4 side than a circuit branch point to the intermediate electrode 2. The resistance values of the first resistor 8*a* and the second resistor 8*b* are preferably adjusted as appropriate so that (1) an electrical field is formed between the cathode 3 and the anode 4 by providing a difference in potential such that the second voltage is relatively more positive than the first voltage, and (2) a voltage is applied to the intermediate electrode 2 within a range that is relatively more positive than the first voltage and relatively more negative than the second voltage.

The first resistor 8*a* and the second resistor 8*b* may be fixed resistors or variable resistors.

Three power sources 6 (not shown), i.e., a power source that applies a voltage to the cathode 3, a power source that applies a voltage to the intermediate electrode 2, and a power source that applies a voltage to the anode 4 may be provided. Power sources that are typically used in the field of electron guns can be used as the power sources 6.

There is no particular limitation as to the light source 7, provided that an electron beam B can be released due to the photocathode 3 being irradiated with excitation light L. Examples of the light source 7 include high-output (watt-class), high-frequency (hundreds of megahertz), ultrashort-pulse laser light sources, comparatively inexpensive laser diodes, and LEDs. The irradiated excitation light L may be pulsed or continuous, and is preferably adjusted as appropriate in accordance with a purpose. In the example shown in FIG. 1, the light source 2 is disposed outside of the vacuum chamber CB. Alternatively, the light source 2 may be disposed inside the vacuum chamber CB.

(Overview of Intermediate Electrode 2)

An overview of the intermediate electrode 2 is described with reference to FIG. 3. FIG. 3A is a schematic cross-sectional view of the cathode 3, the intermediate electrode 2, and the anode 4. FIG. 3B is a cross-sectional view along X-X' in FIG. 3A. FIG. 3C is a cross-sectional view along Y-Y' in FIG. 3A. In the example shown in FIG. 3, the intermediate electrode 2 is formed as a hollow cylinder. The electron-beam passage hole 21 through which the electron beam released from the photocathode 3 passes is formed in the interior of the intermediate electrode 2, an electron-beam entrance 22 is formed on the photocathode 3 side of the electron-beam passage hole 21, and an electron-beam exit 23 is formed on the anode 4 side of the electron-beam passage hole 21. A voltage is applied so that a difference in potential is generated between the cathode 3 and the anode 4, and a voltage is also applied to the intermediate electrode 2, whereby electrical fields EF are generated between the cathode and the intermediate electrode 2 and also between the intermediate electrode 2 and the anode 4, as shown in FIG. 3A.

The electrical field EF that is generated will strongly affect the behavior of the electron beam within a void over a range that, when the void opening is a circle, is a sphere containing the circle as a largest cross-section. Specifically, a sphere of radius a/2 centered on the center of the electron-beam entrance 22 of the electron-beam passage hole 21 will be strongly affected by the generated electrical field EF, a being defined as the diameter of the electron-beam entrance 22 shown in FIG. 3B. Similarly, a sphere of radius b/2 centered on the center of the electron-beam exit 23 of the electron-beam passage hole 21 will be strongly affected by the generated electrical field EF, b being defined as the diameter of the electron-beam exit 23 shown in FIG. 3C. Therefore, when the ratio D/(a/2+b/2) is greater than 1, where D is defined as the center-axis-direction length of the electron-beam passage hole 21, a drift space 24 that is not affected by the electrical field EF is formed within the electron-beam passage hole 21. In the present specification, the "center-axis direction" refers to a direction in which the center of the electron-beam entrance 22 and the center of the electron-beam exit 23 are connected.

As described above, the drift space 24 is formed when D/(a/2+b/2) is greater than 1. There is no particular limitation as to D/(a/2+b/2), provided that this ratio is greater than 1. However, in order to increase the range of adjustment of the focal position, the drift space 24 preferably has a given length; for example, D/(a/2+b/2) is preferably set to 1.5 or higher, 2 or higher, 3 or higher, 4 or higher, 5 or higher, etc., as appropriate. There is no particular upper limit to D/(a/2+b/2), provided that this ratio is within a range in which the electron beam released from the photocathode 3 can pass through the electron-beam passage hole 21. However, if D/(a/2+b/2) increases, i.e., if the length D of the electron-beam passage hole 21 is too high, a problem is presented in that the electron gun 1 will increase in size. Therefore, from the standpoint of device design, D/(a/2+b/2) is preferably 1000 or less, and is preferably set as necessary to 500 or less, 100 or less, 50 or less, or other range, as appropriate.

Figure 3:
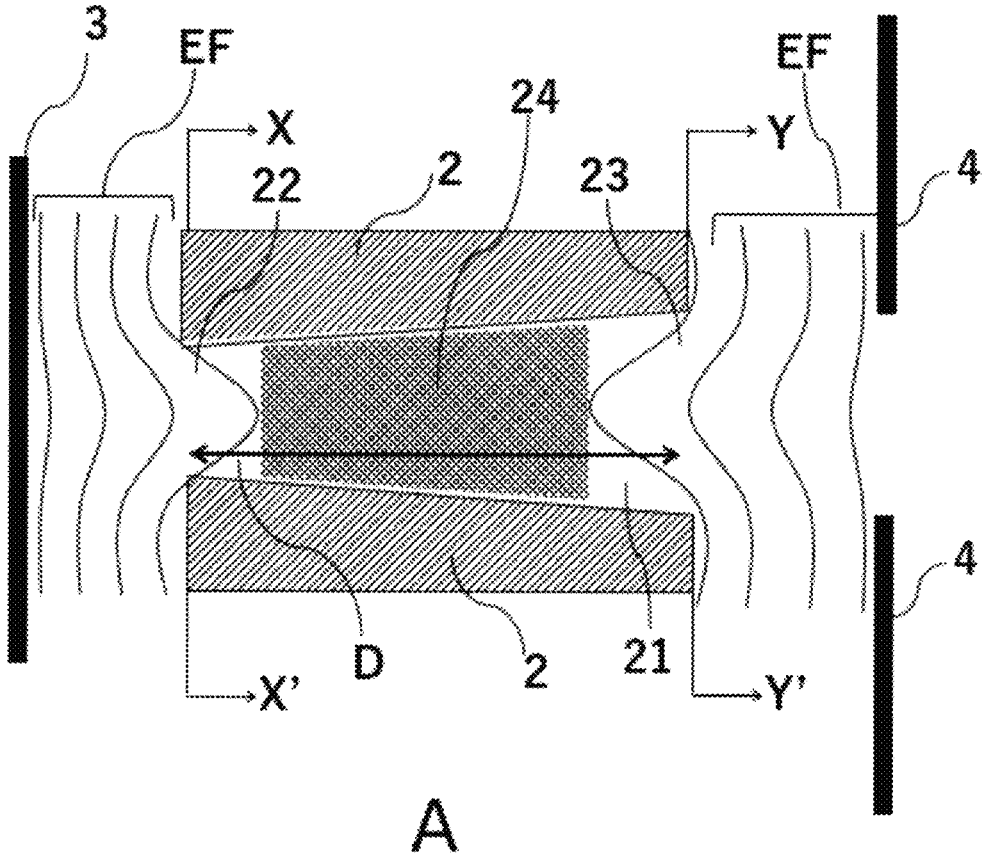
FIG. 3 is a view illustrating an overview of an intermediate electrode 2.
Figure 3:
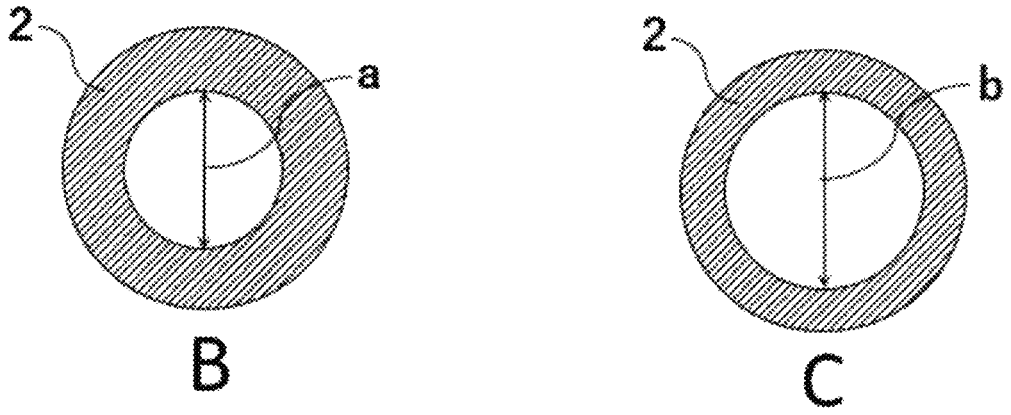

In the example shown in FIG. 3, the intermediate electrode 2 is a hollow cylinder and the electron-beam passage hole 21 is conical, but there are no particular limitations as to these shapes, provided that the intermediate electrode 2 has the electron-beam passage hole 21 and the drift space 24 is formed. For example, the electron-beam passage hole 21 may be polygonal in cross-sectional shape; in this case, and "b" are preferably set as the diameters of circles circumscribing the polygonal shape. In this case, a line connecting the centers of the circumscribed circles is preferably set as the "center-axis direction." When a cross-section of the electron-beam passage hole 21 is ellipsoidal, "a" and "b" are preferably set as the long axes of the ellipses. In this case, a line connecting the midpoints of the long axes is preferably set as the "center-axis direction." In the example shown in FIG. 3, the electron-beam entrance 22 is smaller than the electron-beam exit 23, i.e., the relationship a<b is satisfied; however, a and b may satisfy the relationship a=b or a>b. In the example shown in FIG. 3A, the line connecting the electron-beam entrance 22 and the electron-beam exit 23 is straight as seen in a cross-section, but this line may be non-straight as seen in a cross-section. For example, the length of a cross-section of a center part of the electron-beam passage hole 21 (a cross-section of a portion forming the drift space) may be set greater than a and b, whereby the electron-beam passage hole 21 is substantially barrel-shaped. The width of the electron beam increases within the drift space 24, but it is preferable that the electron beam of which the width has spread does not collide with a wall surface of the electron-beam passage hole. Therefore, the extent to which the width of the electron beam will spread is preferably calculated on the basis of the range of adjustment of the focal position, and the size of the cross-section of the electron-beam passage hole 21 is preferably determined as appropriate.

The intermediate electrode 2 is preferably disposed between the cathode 3 and the anode 4. However, if the position in which the intermediate electrode 2 is disposed is too close to the cathode 3 or the anode 4, i.e., when a discharge boundary is exceeded, the electron beam will not be released. Therefore, the intermediate electrode 2 is preferably disposed so that the distances to the cathode 3 and the anode 4 do not exceed the discharge boundary.

In the example shown in FIG. 3, the intermediate electrode 2 is formed as a single member, but the intermediate electrode 2 may be formed as a divided structure in which a plurality of members are combined, provided that the electrical field EF formed between the cathode 3 and the anode 4 does not enter the electron-beam passage hole 21 from a portion other than the electron-beam entrance 22 and the electron-beam exit 23.

There is no particular limitation as to the material for fabricating the intermediate electrode 2, provided that the material is a conductor. Examples include stainless steel (SUS) and other metals.

Figure 4:
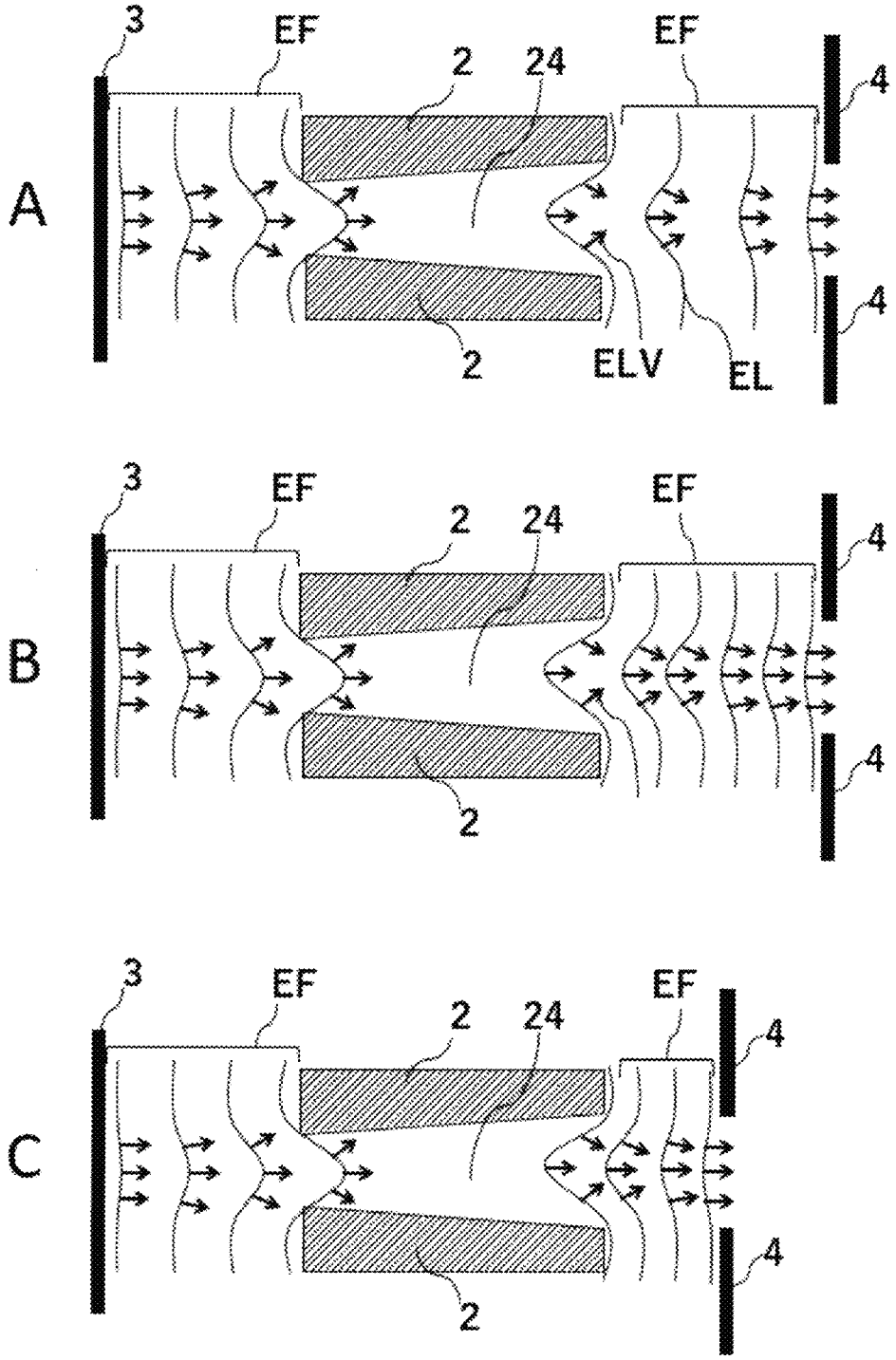
FIG. 4 is a view for illustrating principles by which focal distance can be adjusted by providing the intermediate electrode 2, which has a drift space 24, between a cathode 3 and an anode 4.
Figure 5:
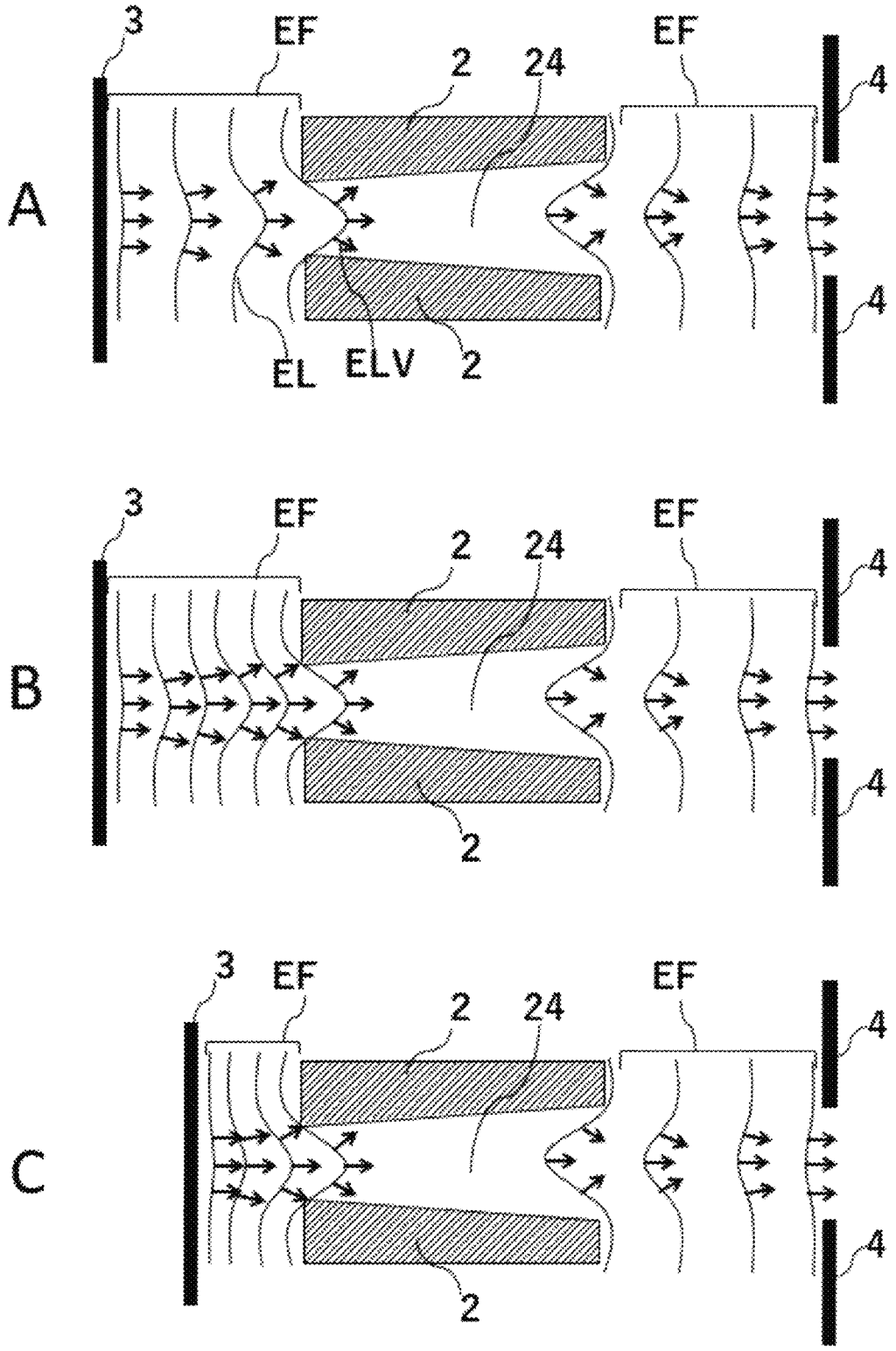
FIG. 5 is a view for illustrating principles by which focal distance can be adjusted by providing the intermediate electrode 2, which has a drift space 24, between a cathode 3 and an anode 4.

The principles by which focal distance can be adjusted by providing the intermediate electrode 2, which has the drift space 24, between the cathode 3 and the anode 4 are described with reference to FIGS. 4 and 5. FIG. 4 is a view for illustrating principles in effect between the intermediate electrode 2 and the anode 4. FIG. 5 is a view for illustrating principles in effect between the cathode 3 and the intermediate electrode 2.

It is known that when an electron beam passes through an electrical field, the electron beam receives force from the electrical field on the basis of the following principles.

Principle 1: An electron beam receives stronger force at positions further from the center axis of the electron beam.

Principle 2: An electron beam receives stronger force as the electron beam crosses more equipotential lines per unit length.

Principle 3: When an electron beam crosses an equipotential line, the force received in a perpendicular direction (relative to an advancement direction) decreases as the energy in the advancement direction increases.

The shape of the electron beam is determined according to the total force received on the basis of these principles. Specifically, adjusting the balance of forces received in accordance with these principles makes it possible to form the shape of the electron beam, and as a result makes it possible to adjust the focal position.

First, the principles in effect between the intermediate electrode 2 and the anode 4 are described with reference to FIG. 4. As shown in FIG. 4A, an electrical field FE is generated between the intermediate electrode 2 and the anode 4 due to a difference in potential. In this instance, equipotential lines EL are formed in the electrical field EF, and a force ELV in directions normal to the equipotential lines EL is generated. Specifically, the electron beam is affected by the normal-direction force ELV.

A behavior in which the electron beam released from the intermediate electrode 2 toward the anode 4 converges is described next. As shown in FIG. 4A, an equipotential line EL enters the gap in the intermediate electrode 2 at the electron-beam exit of the intermediate electrode 2, but in accordance with deviation from the center-axis direction, the normal-direction force ELV will be angled away from parallel to the center-axis direction. Specifically, the normal-direction force ELV in a portion where the equipotential line EL and the center-axis direction intersect imparts forward force to the electron beam, but a force that reduces the beam size of the electron beam in the center-axis direction increases further away from the intersection portion due to a vector component of the normal-direction force ELV. Therefore, the focal point will become shorter because the force imparted to the electron beam that reduces the beam size thereof in the center-axis direction increases commensurately with an increase in the width of the electron beam immediately following passage through the drift space 24 (principle 1).

A first example of adjustment of the focal position, in a case where the electron beam has the same width immediately following passage through the drift space 24, is described next. FIG. 4B shows an example in which the distance between the intermediate electrode 2 and the anode 4 remains the same but the difference in potential between the intermediate electrode 2 and the anode 4 is changed. As shown in FIG. 4B, when the difference in potential between the intermediate electrode 2 and the anode 4 is increased to a greater extent than in FIG. 4A, the density of equipotential lines EL also increases due to an increase in the generated electrical field. Specifically, the force imparted to the electron beam increases (principle 2). Therefore, the force that reduces the beam size of the electron beam, which has increased in width due to passing through the drift space 24, in the center-axis direction increases to a greater extent than in the example shown in FIG. 4A, and the focal point moves toward a shorter focal point. By contrast, when the difference in potential between the intermediate electrode 2 and the anode 4 is decreased than in FIG. 4A, the focal point moves toward a longer focal point.

FIG. 4C shows a second example of adjustment of the focal position in a case where the width of the electron beam has the same magnitude immediately following passage through the drift space 24. FIG. 4C shows an example in which the difference in potential between the intermediate electrode 2 and the anode 4 remains the same but the distance between the intermediate electrode 2 and the anode 4 is changed. As shown in FIG. 4C, when the distance between the intermediate electrode 2 and the anode 4 is decreased than in FIG. 4A, the density of equipotential lines EL increases. Specifically, the force that reduces the beam size of the electron beam in the center-axis direction is imparted in a shorter time (over a shorter distance) than in FIG. 4A. Therefore, because the force per unit distance that reduces the beam size of the electron beam, which has increased in width due to passing through the drift space 24, in the center axis direction increases to a greater extent than in the example shown in FIG. 4A (principle 2), the focal point moves toward a shorter focal point. By contrast, when the distance between the intermediate electrode 2 and the anode 4 is increased than in FIG. 4A, the focal point moves toward a longer focal point.

The principles in effect between the cathode 3 and the intermediate electrode 2 are described next with reference to FIG. 5. As shown in FIG. 5A, an electrical field FE is generated between the cathode 3 and the intermediate electrode 2 due to a difference in potential. In this instance, as in FIG. 4A, equipotential lines EL are formed in the electrical field EF, and a force ELV in directions normal to the equipotential lines EL is generated. Specifically, the released electron beam is affected by the normal-direction force ELV.

A first example of adjustment of the width of the electron beam when the electron beam released from the cathode 3 approaches the intermediate electrode 2 is described next. FIG. 5B shows an example in which the distance between the cathode 3 and the intermediate electrode 2 remains the same but the difference in potential between the cathode 3 and the intermediate electrode 2 is changed. As shown in FIG. 5B, when the difference in potential between the cathode 3 and the intermediate electrode 2 is increased than in FIG. 5A, the density of equipotential lines EL also increases due to an increase in the generated electrical field. Specifically, because the energy in the advancement direction increases, the force received in a perpendicular direction (relative to the advancement direction) decreases (principle 3). Specifically, the force that would spread the electron beam decreases. Although a force that would spread the electron beam according to principle 2 would also be received in such instances, by adopting conditions (the difference in potential or the distance between electrodes) under which principle 3 would be superior in view of the resulting effect, the width of the electron beam released from the cathode 3 when the electron beam approaches the intermediate electrode 2 will be smaller in the example shown in FIG. 5B than in the example shown in FIG. 5A.

By contrast, in cases where the difference in potential between the cathode 3 and the intermediate electrode 2 is lessened than in FIG. 5A, the force advancing forward along the center-axis direction decreases to a greater extent than in the example shown in FIG. 5A; therefore, the force received in the perpendicular direction (relative to the advancement direction) increases (principle 3). Specifically, the force that would spread the electron beam increases, and therefore the electron beam spreads even more than in the example shown in FIG. 5A. Due to the fact that the electrical field is not generated in the drift space 24, the width of the electron beam having energy in the spreading direction at the entrance to the drift space 24 increases further within the drift space 24.

A second example of adjustment of the width of the electron beam when the electron beam released from the cathode 3 approaches the intermediate electrode 2 is described next. FIG. 5C shows an example in which the difference in potential between the cathode 3 and the intermediate electrode 2 remains the same but the distance between the cathode 3 and the intermediate electrode 2 is changed. As shown in FIG. 5C, when the distance between the cathode 3 and the intermediate electrode 2 is reduced than in FIG. 5A, the density of equipotential lines EL increases. Specifically, because the energy in the advancement direction increases, the force received in a perpendicular direction (relative to the advancement direction) decreases (principle 3). Specifically, the force that would spread the electron beam decreases. Although a force that would spread the electron beam according to principle 2 would also be received in such instances, by adopting conditions (the difference in potential or the distance between electrodes) under which principle 3 would be superior in view of the resulting effect, the width of the electron beam released from the cathode 3 when the electron beam approaches the intermediate electrode 2 will be smaller in the example shown in FIG. 5C than in the example shown in FIG. 5A.

By contrast, in cases where the distance between the cathode 3 and the intermediate electrode 2 is increased than in FIG. 5A, because the density of equipotential lines EL decreases, the force advancing forward along the center-axis direction decreases than in the example shown in FIG. 5A. In this case, the force received in the perpendicular direction (relative to the advancement direction) increases (principle 3). Specifically, the force that would spread the beam increases. Therefore, the width of the electron beam spreads even more than in the example shown in FIG. 5A. Because the electrical field is not generated in the drift space 24, the width of the electron beam having energy in the spreading direction at the entrance to the drift space 24 increases further within the drift space 24.

The width of the electron beam increases during passage through the drift space 24 to a greater extent commensurately with increases in the length of the drift space 24, although detailed description of this relationship is omitted. Therefore, in the electron gun disclosed in the present specification, by combining the adjustment of the density of equipotential lines EL between the intermediate electrode 2 and the anode 4 (adjustment of the distance and the difference in potential between the intermediate electrode 2 and the anode 4), the adjustment of the density of equipotential lines EL between the cathode 3 and the intermediate electrode 2 (adjustment of the distance and difference in potential between the cathode 3 and the intermediate electrode 2), and the adjustment of the length of the drift space 24, it is possible to suitably adjust the focal position in both toward a longer focal point and toward a shorter focal point after the electronic gun was fitted on the counterpart device.

Various types of embodiments of adjustment of the focal position are described below.

(First Embodiment of Adjustment of Focal Position)

Figure 6:
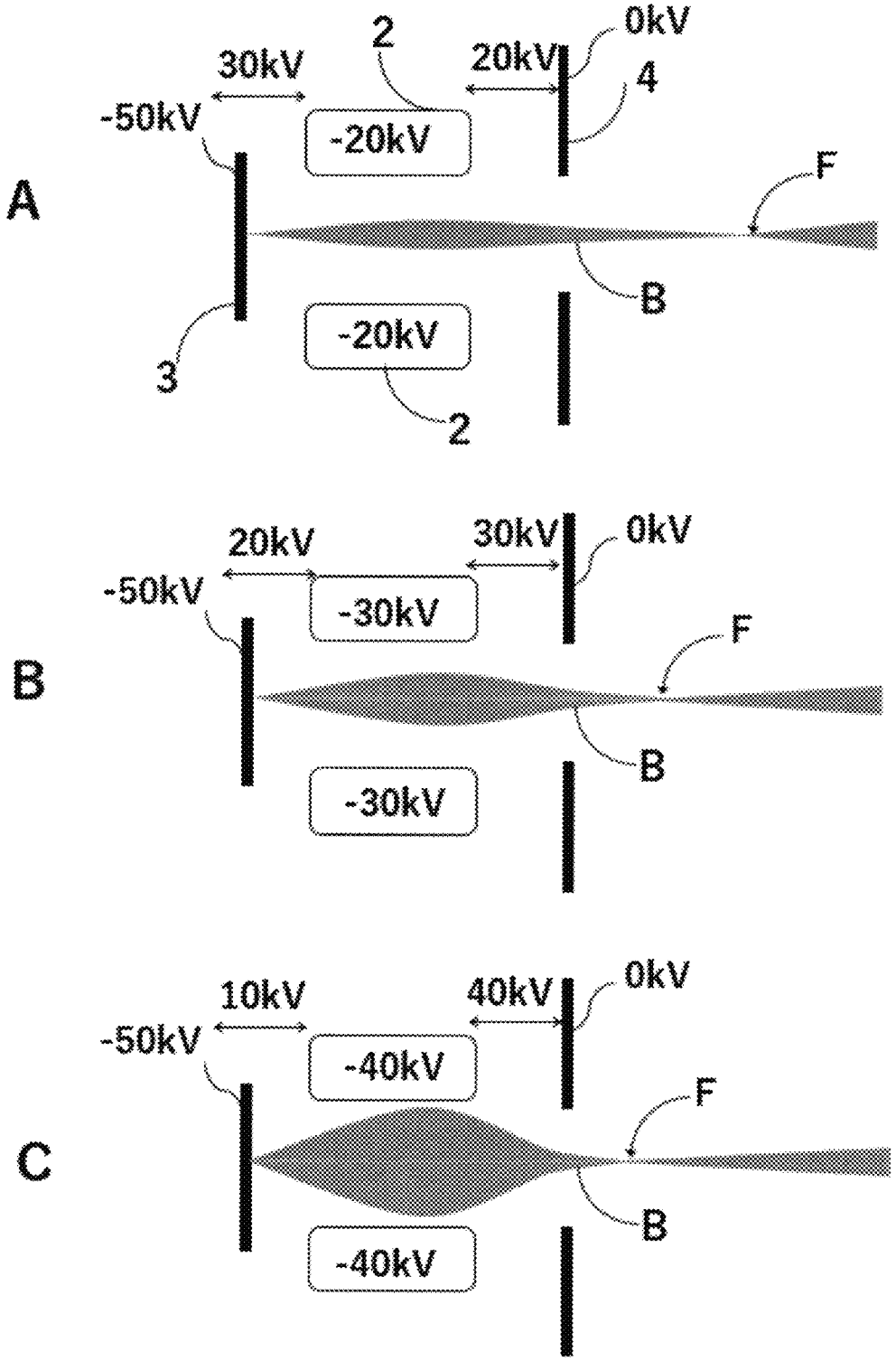
FIG. 6 is a view for illustrating an overview of a first embodiment of adjustment of a focal position.

FIG. 6 is a view for illustrating an overview of a first embodiment of adjustment of a focal position. FIG. 6 shows an example in which the difference between the voltages applied to the cathode 3 and the anode 4 is fixed, and the voltage value applied to the intermediate electrode 2 is varied, whereby the focal position is adjusted. As shown in FIGS. 6A to 6C, the voltage of the cathode 3 is set to −50 kV and the voltage of the anode 4 is set to 0 kV, and the voltage applied to the intermediate electrode 2 is set to −20 kV in FIG. 6A, −30 kV in FIG. 6B, and −40 kV in FIG. 6C. Accordingly, the difference in potential between the cathode 3 and the intermediate electrode 2 is 30 kV in FIG. 6A, 20 kV in FIG. 6B, and 10 kV in FIG. 6C. Specifically, the difference in potential between the cathode 3 and the intermediate electrode 2 decreases as the voltage applied to the intermediate electrode 2 approaches the voltage of the cathode 3. The density of the equipotential lines between the cathode 3 and the intermediate electrode 2 decreases as the difference in potential decreases, and therefore the electron beam B released from the photocathode 3 will more likely spread toward the intermediate electrode 2 from FIG. 6A to FIG. 6C in sequence. Furthermore, because the drift space is formed in the intermediate electrode 2, the electron beam B that will more likely spread furthermore spreads inside the drift space.

However, because the difference in potential between the cathode 3 and the anode 4 is fixed, the difference in potential between the intermediate electrode 2 and the anode 4 is the opposite of the difference in potential between the cathode 3 and the intermediate electrode 2. Specifically, because the difference in potential between the intermediate electrode 2 and the anode 4 increases from FIG. 6A to FIG. 6C in sequence, the density of equipotential lines between the intermediate electrode 2 and the anode 4 also increases. Furthermore, because the electron beam widens from FIG. 6A to FIG. 6C in sequence after having exited the drift space, the electron beam B that has exited the intermediate electrode 2 is more likely to converge in the example shown in FIG. 6C than in that shown in FIG. 6A. Specifically, a focal position F can move toward a shorter focal point as the difference in potential between the intermediate electrode 2 and the anode 4 increases. As indicated above, in the first embodiment of adjustment of the focal position, the focal position F can be adjusted by merely varying the voltage applied to the intermediate electrode 2, without changing the disposition of the cathode 3, the intermediate electrode 2, and the anode 4.

(Second Embodiment of Adjustment of Focal Position)

Figure 7:
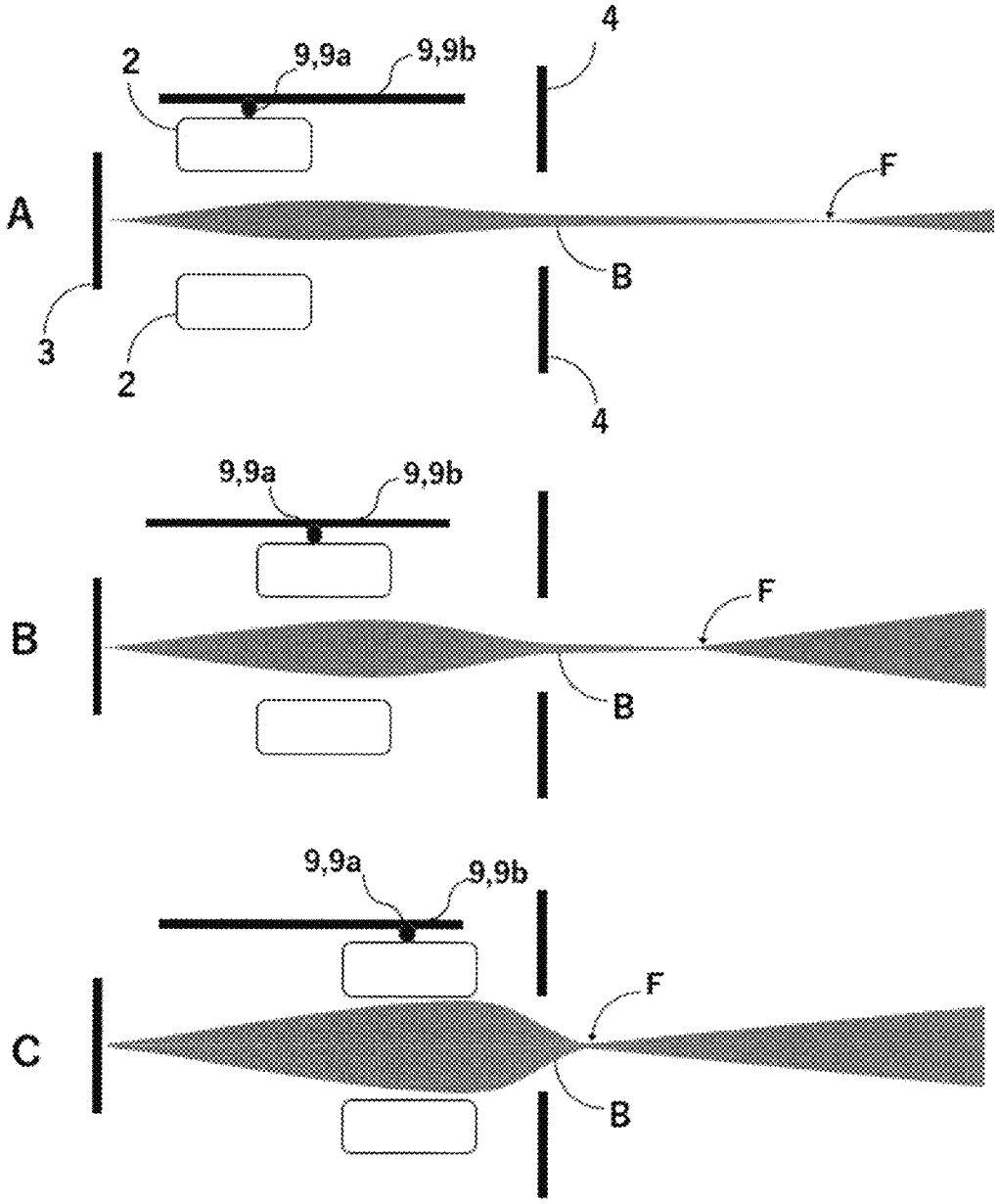
FIG. 7 is a view for illustrating an overview of a second embodiment of adjustment of a focal position.

FIG. 7 is a view for illustrating an overview of a second embodiment of adjustment of a focal position. FIG. 7 shows an example in which the difference in potential between the cathode and the anode 4 and the voltage value applied to the intermediate electrode 2 are fixed, and a drive unit 9 that drives the intermediate electrode 2 in the center-axis direction of the electron-beam passage hole 21 between the cathode 3 and the anode 4 is provided. In the example shown in FIG. 7, the intermediate electrode 2 is driven by a rack-and-pinion structure in which a motor 9*a* is secured to the intermediate electrode 2, and in which a pinion secured to a shaft of the motor 9*a* is engaged with a rack 9*b*. However, there is no particular limitation as to the drive unit 9, provided that the intermediate electrode 2 can be driven in the center-axis direction.

In the example shown in FIG. 7, the distance between the cathode 3 and the intermediate electrode 2 and the distance between the intermediate electrode 2 and the anode 4 changes due to a change in the position of the intermediate electrode 2 between the cathode 3 and the anode 4. Because the difference in potential between the cathode 3 and the anode 4 and the voltage applied to the intermediate electrode 2 are fixed, changing the position of the intermediate electrode 2 results in a change in the density of equipotential lines between the cathode 3 and the intermediate electrode 2 and in the density of equipotential lines between the intermediate electrode 2 and the anode 4. More specifically, because the difference in potential between the cathode 3 and the intermediate electrode 2 is the same, but the density of equipotential lines between the cathode 3 and the intermediate electrode 2 decreases from FIG. 7A to FIG. 7C in sequence, the electron beam B becomes more likely to spread. Furthermore, because the drift space is formed in the intermediate electrode 2, the electron beam B that will more likely spread furthermore spreads inside the drift space.

However, the density of equipotential lines between the intermediate electrode 2 and the anode 4 is the opposite of that between the cathode 3 and the intermediate electrode 2. Specifically, the density of equipotential lines between the intermediate electrode 2 and the anode 4 increases from FIG. 7A to FIG. 7C in sequence. Furthermore, because the electron beam widens from FIG. 7A to FIG. 7C in sequence after having exited the drift space, the electron beam B that has exited the intermediate electrode 2 becomes more likely to converge from FIG. 7A to FIG. 7C in sequence. Specifically, the focal position can move toward a shorter focal point as the distance between the intermediate electrode 2 and the anode 4 decreases. As indicated above, in the second embodiment of adjustment of the focal position, the focal position can be adjusted by varying the position of the intermediate electrode 2 in the center-axis direction.

(Third Embodiment of Adjustment of Focal Position)

Figure 8:
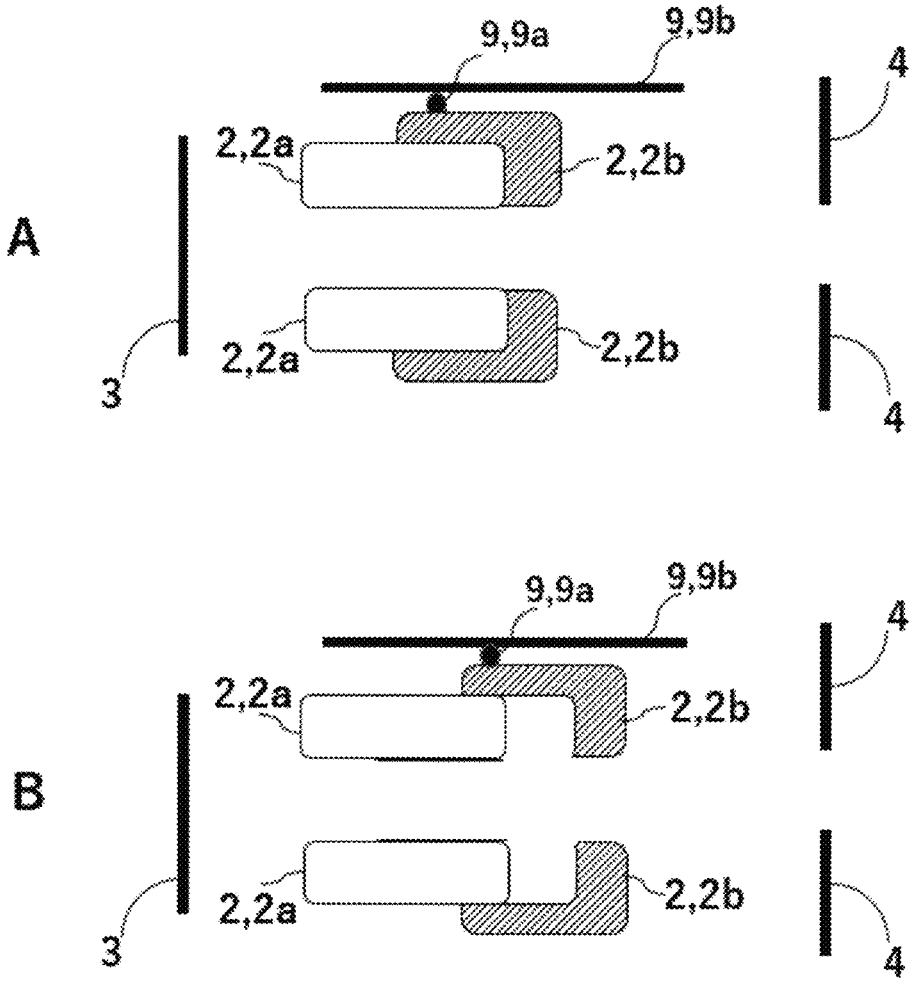
FIG. 8 is a view for illustrating an overview of a third embodiment of adjustment of a focal position.
Figure 9:
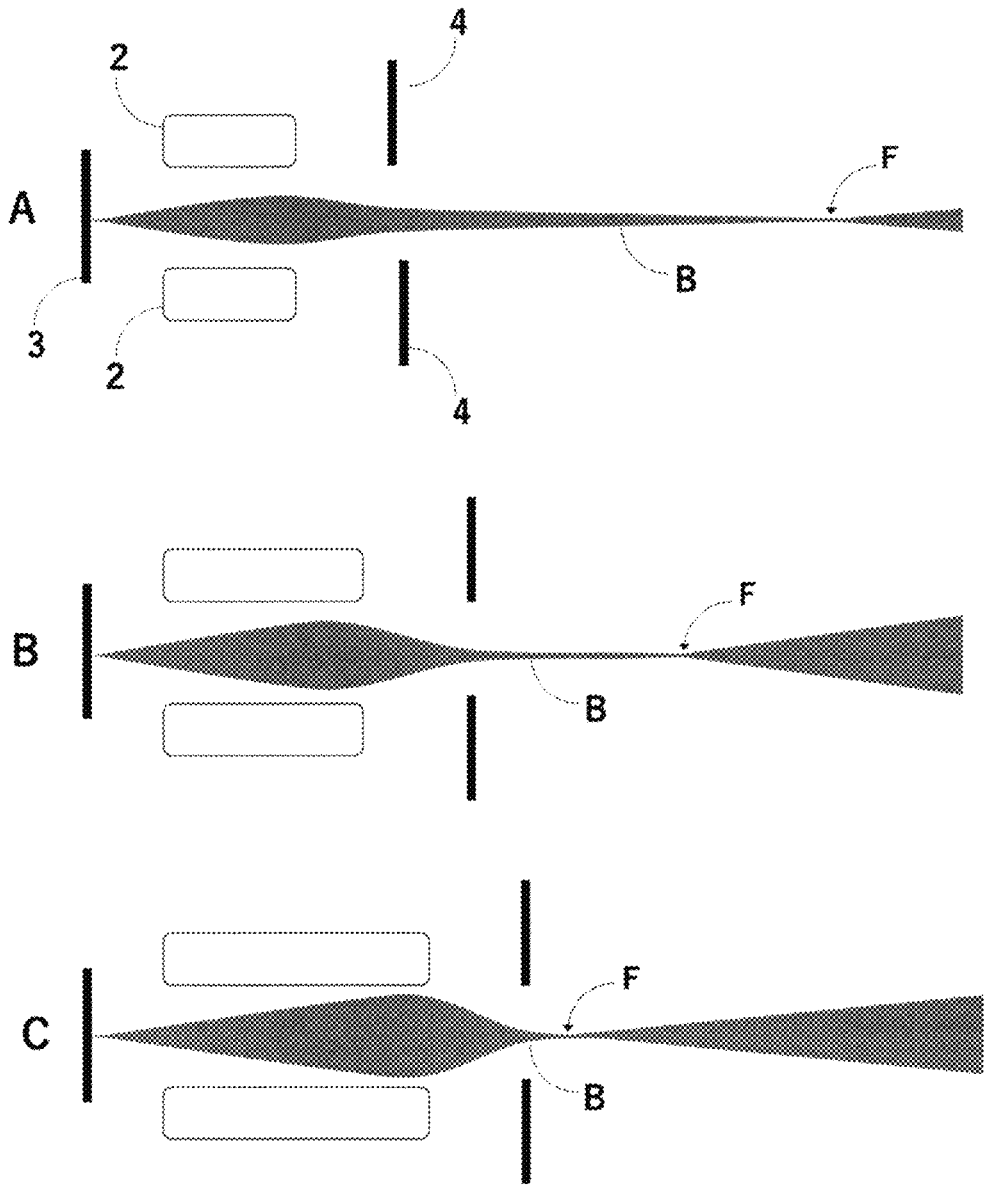
FIG. 9 is a view for illustrating an overview of the third embodiment of adjustment of a focal position.

FIGS. 8 and 9 are views for illustrating an overview of a third embodiment of adjustment of a focal position. An overview of the intermediate electrode 2 used in the third embodiment is first described with reference to FIGS. 8A and 8B. The intermediate electrode 2 used in the third embodiment has a mechanism by which the center-axis-direction length can be varied. In the example shown in FIGS. 8A and 8B, the intermediate electrode 2 is divided into an intermediate-electrode first portion 2*a* and an intermediate-electrode second portion 2*b*. The intermediate-electrode second portion 2*b* can slide relative to the intermediate-electrode first portion 1*a* by a rack-and-pinion structure similar to that in the second embodiment. Therefore, the center-axis-direction length of the intermediate electrode 2 can be changed. The example shown in FIG. 8 is merely an example, there being no particular limitation as to the mechanism by which the center-axis-direction length can be varied, provided that the center-axis-direction length of the intermediate electrode 2 can be changed. For example, the motor 9*a* constituting the rack-and-pinion structure may be secured to the intermediate-electrode first portion 2*a*. Alternatively, the outer-peripheral surface of the intermediate-electrode first portion 1*a* and the inner-peripheral surface of the intermediate-electrode second portion 2*b* may be threaded so as to enable rotatable engagement, and a configuration may be adopted in which one of the intermediate-electrode first portion 1*a* or the intermediate-electrode second portion 2*b* is secured to the electron gun 1, and in which imparting rotational-direction force to the other of the intermediate-electrode first portion 1*a* or the intermediate-electrode second portion 2*b* results in extension or contraction of the intermediate electrode 2 while the intermediate-electrode first portion 1*a* or the intermediate-electrode second portion 2*b* rotates. As another alternative, the intermediate electrode 2 may be formed in a bellows shape and may be formed so as to be capable of extending and contracting in the center-axis direction.

In the example shown in FIGS. 8A and 8B, the distance between the cathode 3 and the anode 4 is fixed. Therefore, when the intermediate electrode 2 is extended, the distance between the intermediate electrode 2 and the anode 4 shortens. FIGS. 8A and 8B show an example in which the length of the drift space and adjustment of the distance between the intermediate electrode 2 and the anode 4 are combined. Alternatively, the intermediate-electrode second portion 2*b* and the anode 4 may be connected by an insulation material (not shown), etc. In this case, because the distance between the intermediate electrode 2 and the anode 4 is fixed, the focal position is changed using only adjustment of the length of the drift space. As shall be apparent, the cathode 3 and the intermediate-electrode first portion 2*a* may be connected by the insulation material, etc., in lieu of the connection of the intermediate-electrode second portion 2*b* and the anode 4.

The third embodiment of adjustment of the focal position is next described with reference to FIG. 9. Detailed description of the intermediate electrode 2 in FIGS. 9A to 9C is omitted to simplify the description, and FIGS. 9A to 9C are described as views in which the length of the intermediate electrode 2 is changed. FIGS. 9A to 9C show an example of a case where the intermediate electrode 2 and the anode 4 are connected by an insulation material (not shown), whereby the distance between the intermediate electrode 2 and the anode 4 is fixed. Specifically, FIGS. 9A to 9C show an example of adjusting the focal position using the length of the intermediate electrode 2. In the third embodiment of adjustment of the focal position, the difference in potential between the cathode 3 and the anode 4 and the voltage applied to the intermediate electrode 2 are fixed. Therefore, because the density of equipotential lines between the cathode 3 and the intermediate electrode 2 remains the same, the width of the electron beam B upon reaching the drift space (the degree of spreading of the electron beam B) remains the same, as shown in FIGS. 9A to 9C. Because the drift space lengthens from FIG. 9A to FIG. 9C in sequence, the electron beam B furthermore spreads inside the drift space from FIG. 9A to FIG. 9C in sequence while passing through the drift space. Moreover, because the distance between the intermediate electrode 2 and the anode 4 is fixed, the density of equipotential lines between the intermediate electrode 2 and the anode 4 remains the same. However, because the drift space lengthens from FIG. 9A to FIG. 9C in sequence, the electron beam B widens from FIG. 9A to FIG. 9C in sequence after having exited the drift space, and as a result, the force for reducing the beam size of the electron beam B in the center-axis direction after the electron beam B has exited the drift space increases from FIG. 9C to FIG. 9A in sequence. Therefore, the electron beam B that has exited the intermediate electrode 2 becomes more likely to converge closer to the state shown in FIG. 9C. Specifically, the focal position F can be moved further toward a shorter focal point as the distance of the drift space in the intermediate electrode 2 increases. As indicated above, in the third embodiment of adjustment of the focal position, the focal position F can be adjusted by varying the length of the intermediate electrode 2 in the center-axis direction and adjusting the length of the drift space.

(Fourth Embodiment of Adjustment of Focal Position)

Figure 10:
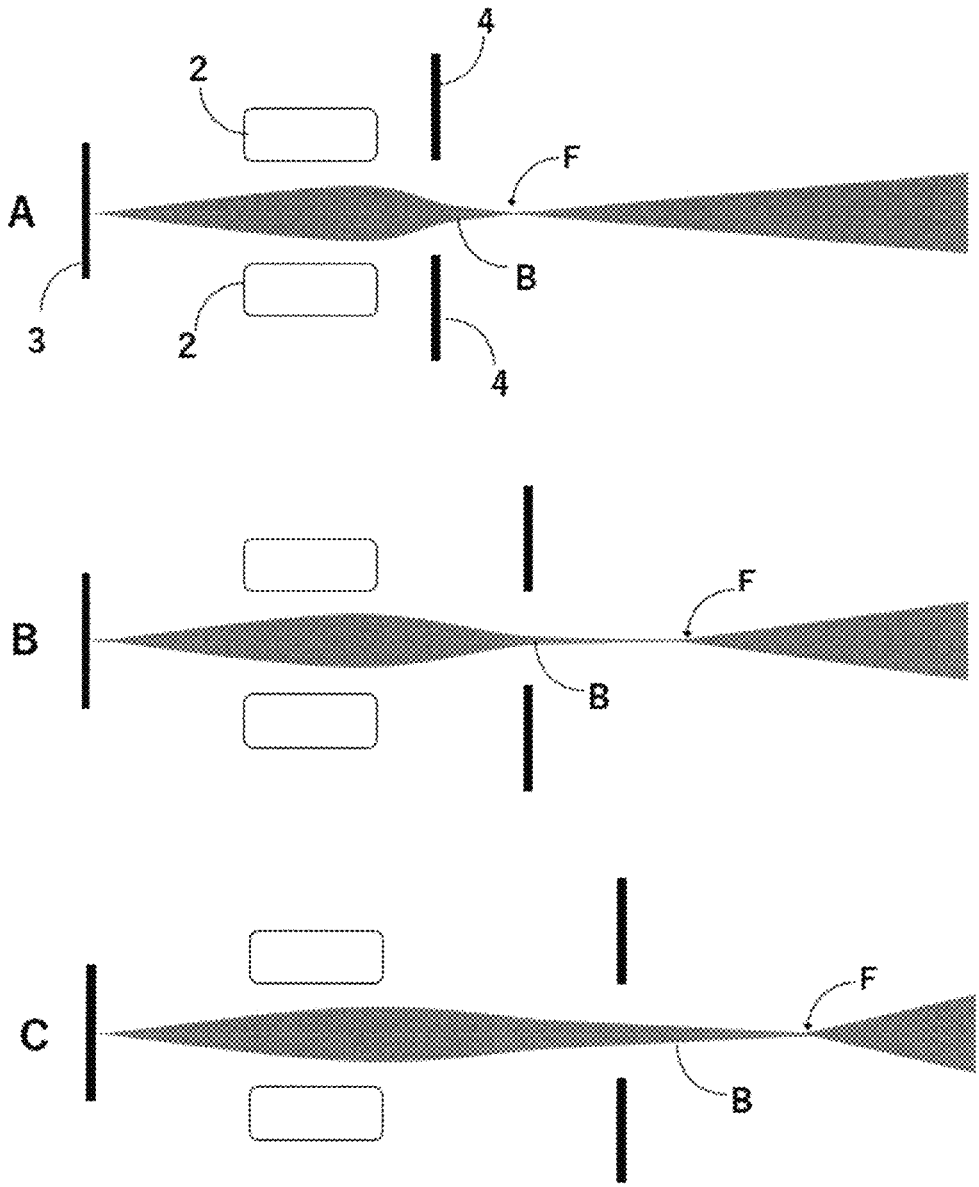
FIG. 10 is a view for illustrating an overview of a fourth embodiment of adjustment of a focal position.

FIG. 10 is a view for illustrating an overview of a fourth embodiment of adjustment of a focal position. In the fourth embodiment of adjustment of the focal position, an example is shown in which the distance between the intermediate electrode 2 and the anode 4 is adjusted by moving the anode 4 in the center-axis direction. There is no particular limitation as to the movement of the anode 4 toward the center-axis direction, provided that the anode 4 can move; a drive unit such as that shown in FIG. 8 is preferably used (though not shown in FIG. 10). In the example shown in FIGS. 10A to 10C, the difference in potential between the cathode 3 and the anode 4, and the length of the intermediate electrode 2, and the voltage applied to the intermediate electrode 2 are fixed. Therefore, because the density of equipotential lines between the cathode 3 and the intermediate electrode 2 and the length of the drift space remain the same, the width of the electron beam B until exiting the drift space (the degree of spreading of the electron beam B) remains the same, as shown in FIGS. 10A to 10C.

However, because the distance between the intermediate electrode 2 and the anode 4 increases from FIG. 10A to FIG. 10C in sequence, the density of equipotential lines between the intermediate electrode 2 and the anode 4 decreases from FIG. 10A to FIG. 10C in sequence. Therefore, although the width of the electron beam prior to exit from the drift space remains the same in FIG. 10C as in FIG. 10A, the force by which the electron beam B converges in the center-axis direction weakens from FIG. 10A to FIG. 10C in sequence. Specifically, the focal position F can be moved toward a longer focal point as the distance between the intermediate electrode 2 and the anode 4 increases. As indicated above, in the fourth embodiment of adjustment of the focal position, the focal position F can be adjusted by varying the position of the anode 4 in the center-axis direction.

(Fifth Embodiment of Adjustment of Focal Position)

Figure 11:
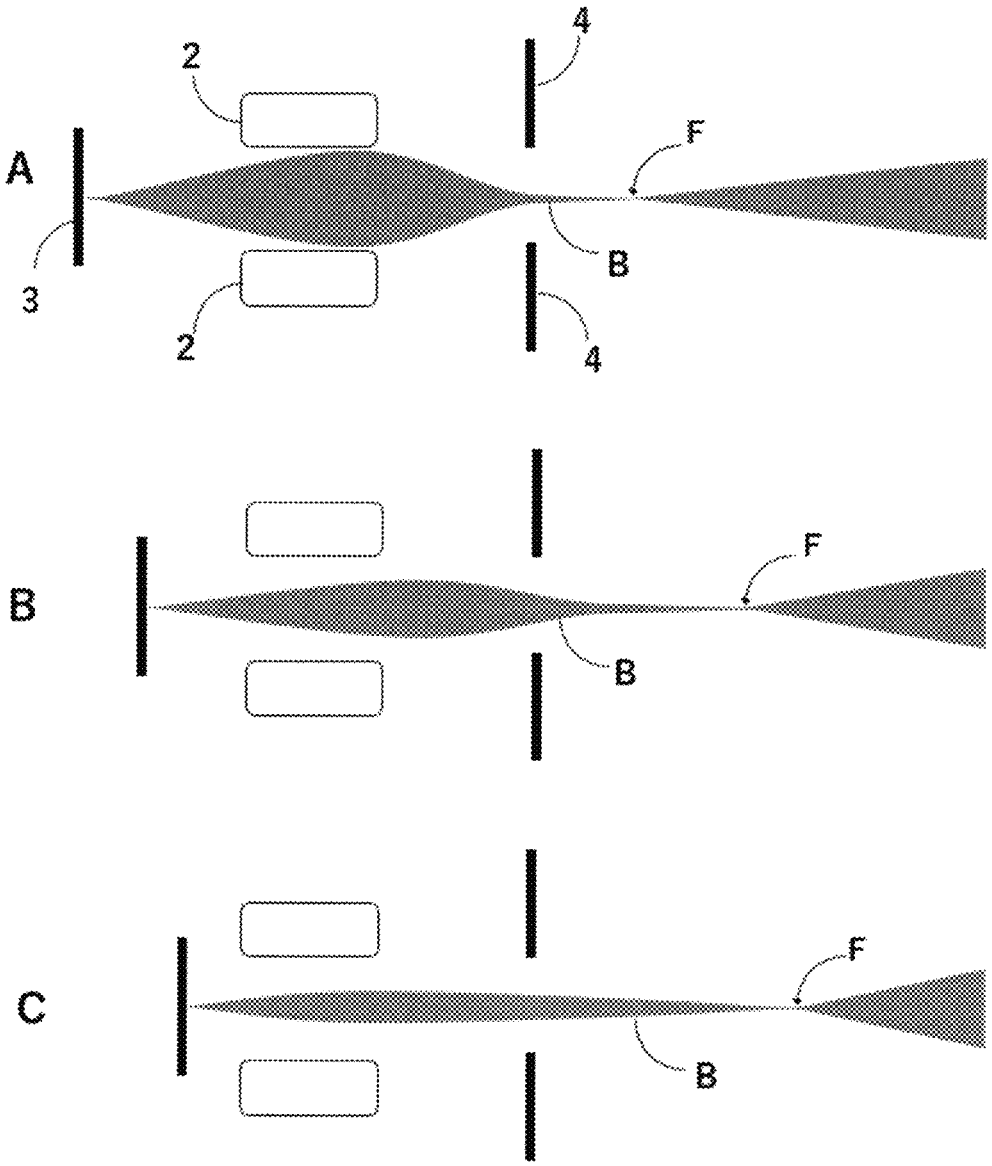
FIG. 11 is a view for illustrating an overview of a fifth embodiment of adjustment of a focal position.

FIG. 11 is a view for illustrating an overview of a fifth embodiment of adjustment of a focal position. In the fifth embodiment of adjustment of the focal position, an example is illustrated in which the distance between the cathode 3 and the intermediate electrode 2 is adjusted by moving the cathode 3 in the center-axis direction, instead of the anode 4 as in the fourth embodiment. There is no particular limitation as to the movement of the cathode 3 toward the center-axis direction, provided that the cathode 3 can move, but a drive unit such as that shown in FIG. 8 is preferably used (though not shown in FIG. 11). In the example shown in FIGS. 11A to 11C, the difference in potential between the cathode 3 and the anode 4, the length of the intermediate electrode 2, and the voltage applied to the intermediate electrode 2 are fixed. Therefore, because the difference in potential between the cathode 3 and the intermediate electrode 2 remains the same, but the density of equipotential lines between the cathode 3 and the intermediate electrode 2 increases from FIG. 11A to 11C in sequence, the width of the electron beam when entering the drift space in the intermediate electrode 2 decreases from FIG. 11A to FIG. 11C in sequence. Therefore, the width of the electron beam B upon exiting the drift space also decreases from FIG. 11A to FIG. 11C in sequence.

Because the distance between the intermediate electrode 2 and the anode 4 is fixed, the density of equipotential lines between the intermediate electrode 2 and the anode 4 remains the same. However, the width of the electron beam B on exiting the drift space increases from FIG. 11C to FIG. 11A in sequence, and as a result, the force for reducing the beam size of the electron beam B in the center-axis direction after the electron beam B has exited the drift space increases from FIG. 11C to FIG. 11A in sequence. Therefore, the electron beam B that has exited the intermediate electrode 2 becomes more likely to converge closer to the state shown in FIG. 11A. Specifically, the focal position F can move toward a longer focal point as the distance between the cathode 3 and the intermediate electrode 2 decreases. As indicated above, in the fifth embodiment involving adjustment of the focal position, the focal position F can be adjusted by varying the position of the cathode 3 in the center-axis direction.

Each of the first to fifth embodiments of adjustment of the focal position may be implemented alone or in combination.

(Embodiment of Method for Releasing Electron Beam)

Figure 12:
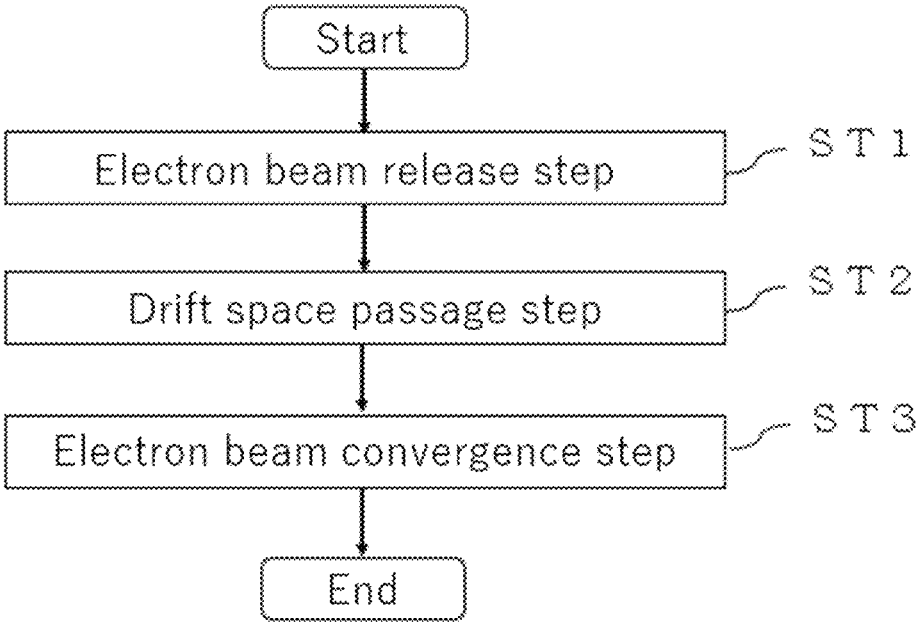
FIG. 12 is a view for illustrating an embodiment of a method for releasing an electron beam.

An embodiment of a method for releasing the electron beam is described with reference to FIG. 12. This embodiment of a release method includes at least an electron beam release step (ST1), a drift space passage step (ST2), and an electron beam convergence step (ST3). In the electron beam release step (ST1), the photocathode is irradiated with excitation light from the light source, whereby the electron beam is released from the photocathode toward the anode. In the drift space passage step (ST2), the electron beam released from the photocathode passes through the drift space formed in the electron-beam passage hole in the intermediate electrode 2 between the cathode and the anode. In the drift space, it is possible to disregard the effect of an electrical field formed between the cathode and the anode due to application of voltage, and therefore the electron beam spreads within the drift space. In the electron beam convergence step (ST3), the electron beam that has passed through the drift space converges toward the anode, and as a result can be focused in the counterpart device.

(Embodiment of Method for Adjusting Focal Position of Electron Beam)

As indicated above, the drift space passage step (ST2), in which the electron beam is spread inside the drift space, is a novel step found by the inventors; therefore, a method for releasing an electron beam that includes this step is a novel method. It is also possible to add an electron beam width adjustment step, in which the width of the electron beam is actively adjusted, to this novel method for releasing an electron beam, and thereby use the method for releasing an electron beam as a method for adjusting the focal position of an electron beam. The electron beam width adjustment step may be implemented between and/or during any of the steps if it is implemented between the electron beam release step (ST1) and the electron beam convergence step (ST3).

For example, in cases where the electron beam width adjustment step is implemented between the electron beam release step (ST1) and the drift space passage step (ST2), it is preferable to implement a step in which the difference in potential and/or the distance between the cathode and the intermediate electrode 2 is changed. Through this step, the density of equipotential lines between the cathode and the intermediate electrode changes, making it possible to adjust the width of the electron beam (this step is referred to as a "first electron beam width adjustment step" below).

In cases where the electron beam width adjustment step is implemented during the drift space passage step (ST2), it is preferable to implement a step in which the length of the intermediate electrode 2 is changed. Through this step, the length of the drift space, in which the effect of the electrical field can be disregarded, changes, therefore making it possible to adjust the width of the electron beam by adjusting the length of the drift space (this step is referred to as a "second electron beam width adjustment step" below).

In cases where the electron beam width adjustment step is implemented during the electron beam convergence step (ST3), it is preferable to implement a step in which the difference in potential and/or the distance between the intermediate electrode and the anode is changed. Through this step, the density of equipotential lines between the intermediate electrode and the anode changes, therefore making it possible to adjust the width of the electron beam (this step is referred to as a "third electron beam width adjustment step" below).

The first electron beam width adjustment step, the second electron beam width adjustment step, and the third electron beam width adjustment step may be implemented independently or in combination.

Examples of an electron beam applicator E fitted with an electron gun include publicly known devices fitted with electron guns. Specific examples include free electron laser accelerators, electron microscopes, electron-beam holography devices, electron-beam drawing devices, electron-beam diffraction devices, electron-beam inspection devices, electron-beam metal additive manufacturing devices, electron-beam lithography devices, electron beam processing devices, electron-beam curing devices, electron-beam sterilization devices, electron-beam disinfection devices, plasma generation devices, atomic element generation devices, spin-polarization electron-beam generation devices, cathode luminescence devices, and inverse photoemission spectroscopy devices.

The examples below are presented to specifically describe the embodiments disclosed in the present application, but are provided merely for description of the embodiments. The examples are not provided by way of any limitation or restriction on the claims set forth in the present application.

EXAMPLES

Example 1

Figure 13:
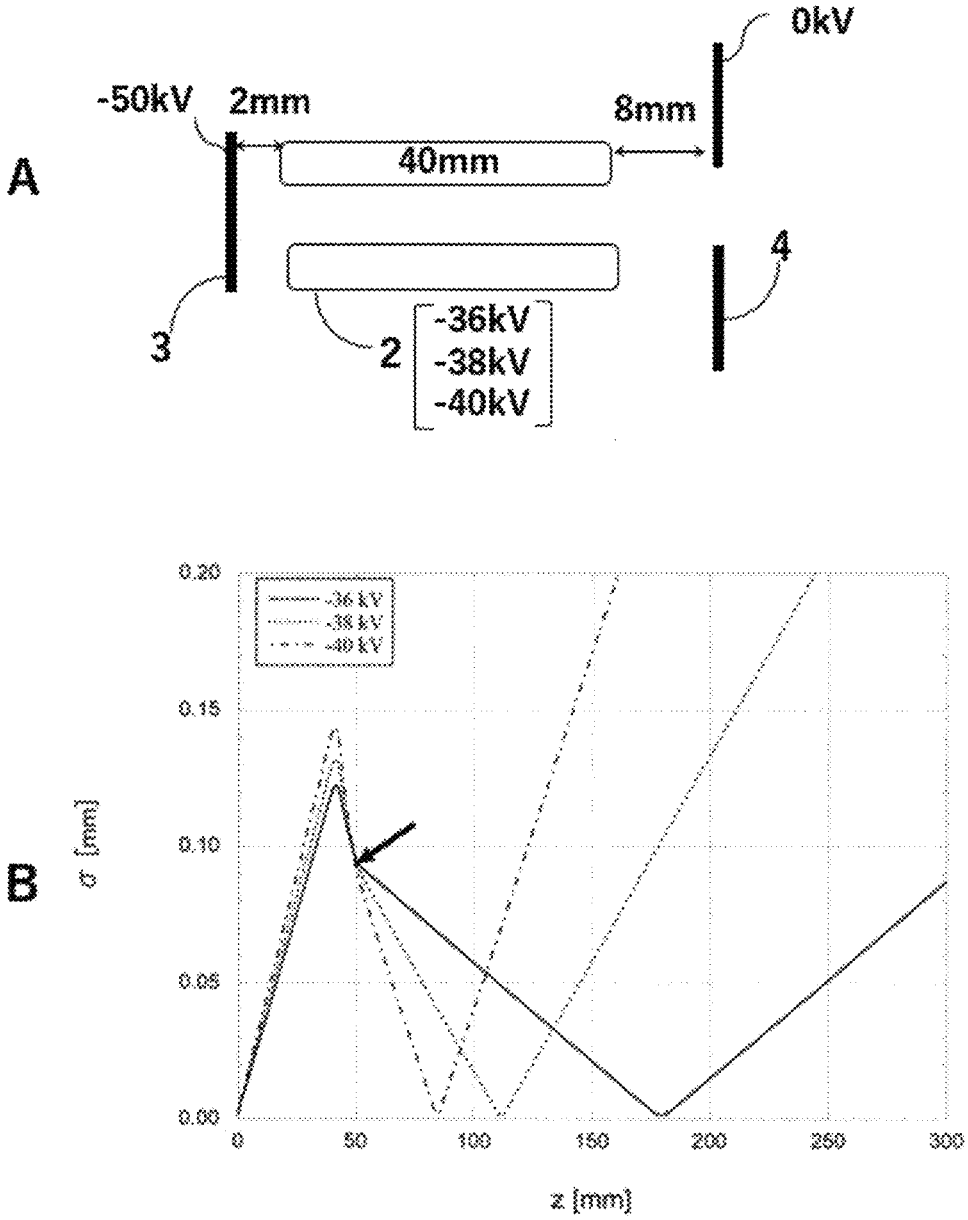
FIG. 13 is a view for illustrating example 1.

Example 1 is described with reference to FIG. 13. FIG. 13A is a view for illustrating conditions in example 1, a simulation being carried out using fixed values such that the voltage applied to the cathode 3 was set to −50 kV, the voltage of the anode 4 was set to 0 kV, the spacing between the cathode 3 and the intermediate electrode 2 was set to 2 mm, the length of the intermediate electrode 2 was set to 40 mm, the electron-beam passage hole was formed in a cylindrical shape having a diameter of 4 mm, and the spacing between the intermediate electrode 2 and the anode 4 was set to 8 mm, with only the voltage applied to the intermediate electrode 2 being configured as a variable value. FIG. 13B is a graph showing results of the simulation. The diameter of the electron beam is plotted on the vertical axis in FIG. 13B, and the distance from the photocathode 3 is plotted on the horizontal axis. The arrow in FIG. 13B indicates the position of the anode 4, and values on the right side of the arrow represent positions at which the electron beam was focused in the counterpart device. As shown in FIG. 13B, in cases where the conditions other than the voltage value applied to the intermediate electrode 2 remained the same, the focal position moved toward a shorter focal point as the voltage value applied to the intermediate electrode 2 approached the voltage value of the cathode 3, and the focal position moved toward a longer focal point as the voltage value applied to the intermediate electrode 2 deviated from the voltage value of the cathode 3. Therefore, it was confirmed that by adjusting the voltage applied to the intermediate electrode 2, i.e., by adjusting the density of equipotential lines between the cathode 3 and the intermediate electrode 2 (first electron beam width adjustment step) and adjusting the density of equipotential lines between the intermediate electrode 2 and the anode 4 (third electron beam width adjustment step), it was possible to adjust the focal position both toward a shorter focal point and toward a longer focal point.

Example 2

Figure 14:
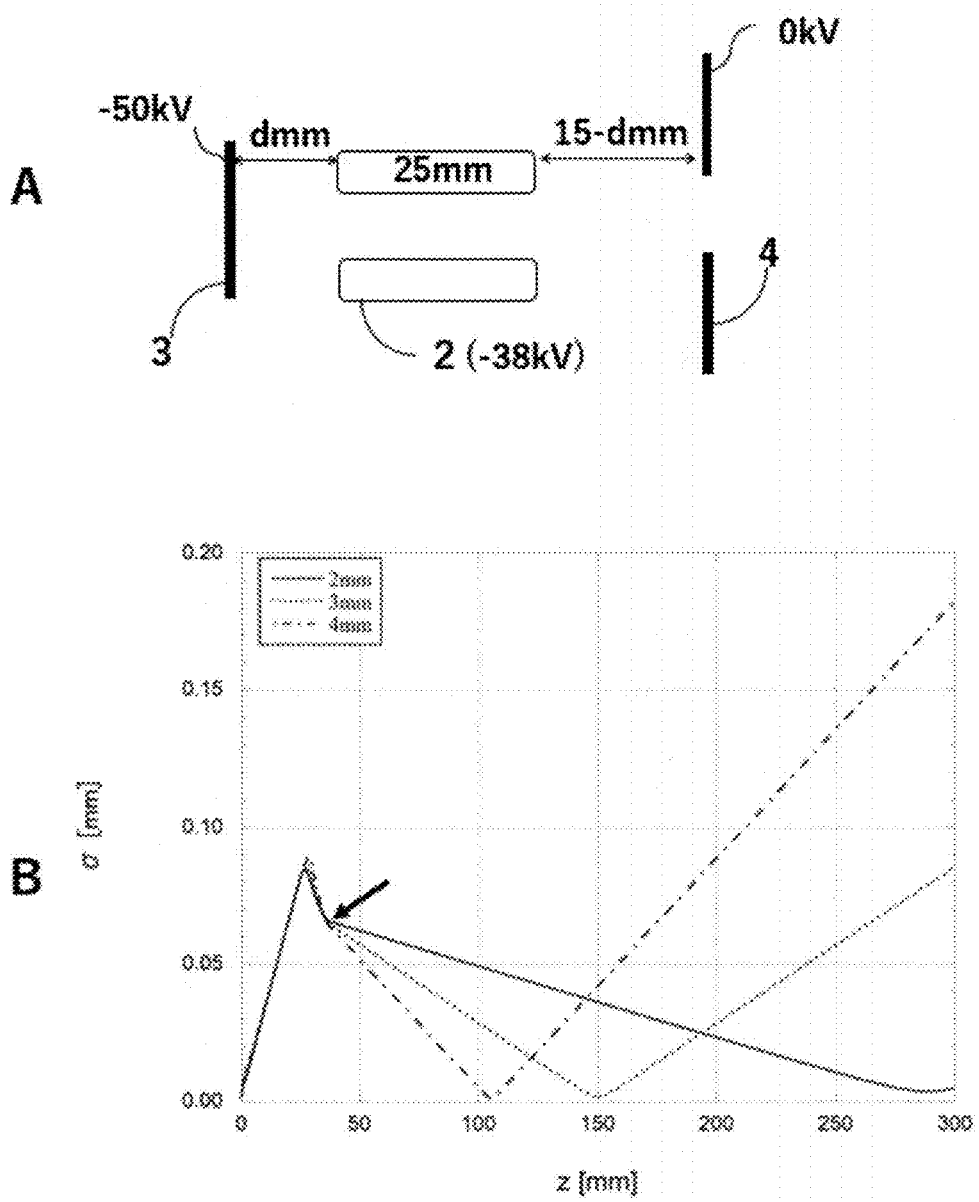
FIG. 14 is a view for illustrating example 2.

Example 2 is described with reference to FIG. 14. FIG. 14A a view for illustrating conditions in example 2, a simulation being carried out using fixed values such that the voltage applied to the cathode 3 was set to −50 kV, the voltage of the anode 4 was set to 0 kV, the length of the intermediate electrode 2 was set to 25 mm, the electron-beam passage hole was formed in a cylindrical shape having a diameter of 4 mm, and the voltage applied to the intermediate electrode 2 was set to −38 kV, with the spacing between the intermediate electrode 2 and the anode 4 being used as a variable value of 15-dmm, where dmm is the spacing between the photocathode 3 and the intermediate electrode. FIG. 14B is a graph showing results of the simulation. The diameter of the electron beam was plotted on the vertical axis in FIG. 14B, and the distance from the cathode 3 was plotted on the horizontal axis. The arrow in FIG. 14B indicates the position of the anode 4, and values on the right side of the arrow represent positions at which the electron beam was focused in the counterpart device. As shown in FIG. 14B, in cases where conditions other than the position of the intermediate electrode 2 remained the same, the focal position moved toward a shorter focal point as the spacing between the cathode 3 and the intermediate electrode 2 increased, and the focal position moved toward a longer focal point as the spacing between the cathode 3 and the intermediate electrode 2 decreased. Therefore, it was confirmed that by adjusting the position of the intermediate electrode 2 between the cathode 3 and the anode 4, i.e., by adjusting the density of equipotential lines between the cathode 3 and the intermediate electrode 2 (first electron beam width adjustment step) and adjusting the density of equipotential lines between the intermediate electrode 2 and the anode 4 (third electron beam width adjustment step), it was possible to adjust the focal position both toward a shorter focal point and toward a longer focal point.

Example 3

Figure 15:
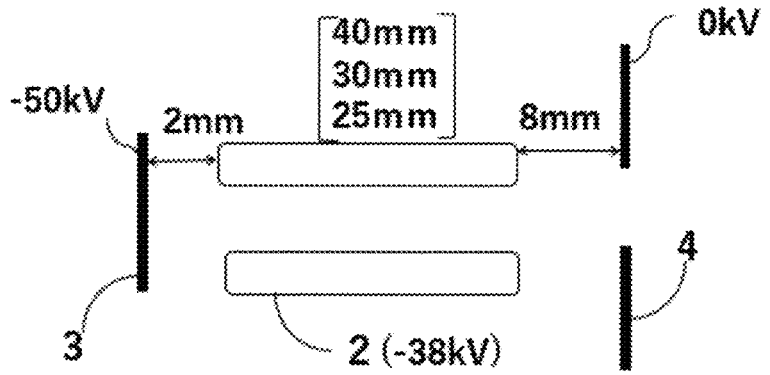
FIG. 15 is a view for illustrating example 3.
Figure 15:
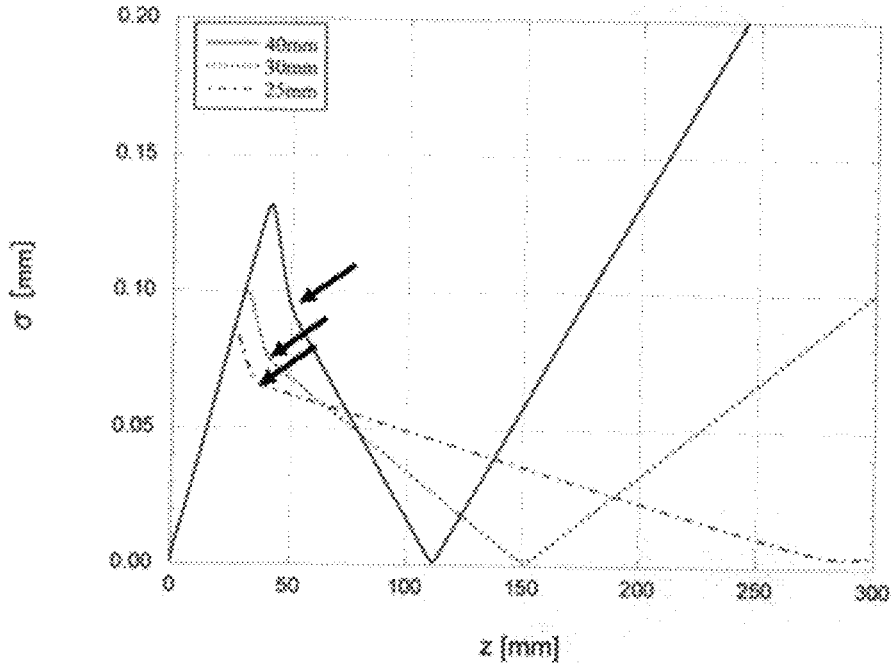

Example 3 is described with reference to FIG. 15. FIG. 15A is a view for illustrating conditions in example 3, a simulation being carried out using fixed values such that the voltage applied to the cathode 3 was set to −50 kV, the voltage of the anode 4 was set to 0 kV, the distance between the cathode 3 and the intermediate electrode 2 was set to 2 mm, the distance between the intermediate electrode 2 and the anode 4 was set to 8 mm, the electron-beam passage hole was formed in a cylindrical shape having a diameter of 4 mm, and the voltage applied to the intermediate electrode 2 was set to −38 kV, with the length of the intermediate electrode 2 being used as a variable value of 25 mm, 30 mm, or 40 mm. FIG. 15B is a graph showing results of the simulation. The diameter of the electron beam was plotted on the vertical axis in FIG. 15B, and the distance from the cathode 3 was plotted on the horizontal axis. The arrow in FIG. 15B indicates the position of the anode 4, and values on the right side of the arrow represent positions at which the electron beam was focused in the counterpart device. As shown in FIG. 15B, in cases where conditions other than the length of the intermediate electrode 2 remained the same, the focal position moved toward a longer focal point as the length of the intermediate electrode 2 decreased, and the focal position moved toward a shorter focal point as the length of the intermediate electrode 2 increased. Therefore, it was confirmed that by adjusting the length of the intermediate electrode 2, i.e., by adjusting the length of the drift space, in which the effect of the electrical field can be disregarded (second electron beam width adjustment step), it was possible to adjust the focal position both toward a shorter focal point and toward a longer focal point.

INDUSTRIAL APPLICABILITY

When the electron gun, the electron beam applicator, and the method for releasing electrons using an electron gun disclosed in the present specification are used, it is possible to adjust the focal position of an electron beam both toward a shorter focal point and toward a longer focal point even after the electronic gun was fitted on the counterpart device. Therefore, the invention is useful for makers who manufacture devices fitted with electron guns, and makers that use these devices or incidence axis alignment methods.

REFERENCE SIGNS LIST

1: electron gun
2: intermediate electrode
2*a*: intermediate-electrode first portion
2*b*: intermediate-electrode second portion
3: photocathode
4: anode
5: photocathode-accommodating vessel
5*h*: electron-beam passage hole
5*m*: treatment material
6: power source
6*a*: first power source
6*b*: second power source
7: light source
8*a*: first resistor
8*b*: second resistor
9: drive unit
9*a*: motor
9*b*: rack
21: electron-beam passage hole
22: electron-beam entrance
23: electron-beam exit
24: drift space
B: electron beam
CB: vacuum chamber
D: center-axis-direction length of electron-beam passage hole
E: electron beam applicator
EF: electrical field
EL: equipotential line
ELV: force in direction normal to equipotential line
F: focal point
L: excitation light
a: diameter of electron-beam entrance
b: diameter of electron-beam exit

The invention claimed is:

1. An electron gun comprising:
a photocathode, and
an anode,
the electron gun furthermore comprising an intermediate electrode disposed between the photocathode and the anode,
the intermediate electrode comprising an electron-beam passage hole through which an electron beam released from the photocathode passes, and
the electron-beam passage hole having formed therein a drift space in which, when an electrical field is formed between the photocathode and the anode due to application of a voltage, the effect of the electrical field can be disregarded, the drift space being used for spreading the width of the electron beam passing therethrough.

2. The electron gun according to claim 1,
wherein the intermediate electrode is such that the ratio D/(a/2+b/2) is greater than 1,
where D is defined as the center-axis-direction length of the electron-beam passage hole,
a is defined as a cross-sectional length of an electron-beam entrance of the electron-beam passage hole, and
b is defined as a cross-sectional length of an electron-beam exit of the electron-beam passage hole.

3. The electron gun according to claim 2,
wherein the electron gun comprises a drive unit for driving the intermediate electrode in the center-axis direction of the electron-beam passage hole between the photocathode and the anode.

4. The electron gun according to claim 2,
wherein a center-axis-direction length D of the electron-beam passage hole in the intermediate electrode is variable.

5. The electron gun according to claim 2,
wherein the electron gun comprises a power source that forms an electrical field between the photocathode and the anode and applies a voltage to the intermediate electrode.

6. The electron gun according to claim 2,
wherein the electron gun comprises a drive unit for driving the photocathode and/or the anode in the center-axis direction of the electron-beam passage hole.

7. The electron gun according to claim 1,
wherein the electron gun comprises a drive unit for driving the intermediate electrode in the center-axis direction of the electron-beam passage hole between the photocathode and the anode.

8. The electron gun according to claim 7,
wherein a center-axis-direction length D of the electron-beam passage hole in the intermediate electrode is variable.

9. The electron gun according to claim 7,
wherein the electron gun comprises a power source that forms an electrical field between the photocathode and the anode and applies a voltage to the intermediate electrode.

10. The electron gun according to claim 9,
wherein the power source can apply, to the intermediate electrode, a voltage within a range that is relatively more positive than a first voltage and relatively more negative than a second voltage, where the first voltage is defined as the voltage of the photocathode, and the second voltage is defined as the voltage of the anode.

11. The electron gun according to claim 1, wherein a center-axis-direction length D of the electron-beam passage hole in the intermediate electrode is variable.

12. The electron gun according to claim 11, wherein the electron gun comprises a power source that forms an electrical field between the photocathode and the anode and applies a voltage to the intermediate electrode.

13. The electron gun according to claim 12, wherein the power source can apply, to the intermediate electrode, a voltage within a range that is relatively more positive than a first voltage and relatively more negative than a second voltage, where the first voltage is defined as the voltage of the photocathode, and the second voltage is defined as the voltage of the anode.

14. The electron gun according to claim 5, wherein the power source can apply, to the intermediate electrode, a voltage within a range that is relatively more positive than a first voltage and relatively more negative than a second voltage, where the first voltage is defined as the voltage of the photocathode, and the second voltage is defined as the voltage of the anode.

15. The electron gun according to claim 1, wherein the electron gun comprises a power source that forms an electrical field between the photocathode and the anode and applies a voltage to the intermediate electrode.

16. The electron gun according to claim 15, wherein the power source can apply, to the intermediate electrode, a voltage within a range that is relatively more positive than a first voltage and relatively more negative than a second voltage, where the first voltage is defined as the voltage of the photocathode, and the second voltage is defined as the voltage of the anode.

17. The electron gun according to claim 1, wherein the electron gun comprises a drive unit for driving the photocathode and/or the anode in the center-axis direction of the electron-beam passage hole.

18. An electron beam applicator comprising the electron gun according to claim 1, wherein the electron beam applicator is a free electron laser accelerator, an electron microscope, an electron-beam holography device, an electron-beam drawing device, an electron-beam diffraction device, an electron-beam inspection device, an electron-beam metal additive manufacturing device, an electron-beam lithography device, an electron beam processing device, an electron-beam curing device, an electron-beam sterilization device, an electron-beam disinfection device, a plasma generation device, an atomic element generation device, a spin-polarization electron-beam generation device, a cathode luminescence device, or an inverse photoemission spectroscopy device.

19. A method for releasing an electron beam using an electron gun, the method for releasing an electron beam comprising:

an electron beam release step in which an electron beam is released from a photocathode toward an anode;

a drift space passage step in which the electron beam released from the photocathode passes through a drift space which is formed in an electron-beam passage hole of an intermediate electrode, in which the effect of an electrical field formed between the photocathode and the anode due to application of a voltage can be disregarded, the drift space being used for spreading a width of the electron beam passing therethrough; and an electron beam convergence step in which the electron beam after the drift space passage step converges toward the anode.

20. A method for adjusting the focal position of an electron beam, the method being such that an electron beam width adjustment step is included between the electron beam release step (ST1) and the electron beam convergence step (ST3) in the method for releasing an electron beam using an electron gun according to claim 19.

* * * * *